US005642423A

United States Patent [19]

Embree

[11] Patent Number: 5,642,423

[45] Date of Patent: Jun. 24, 1997

[54] DIGITAL SURROUND SOUND PROCESSOR

[75] Inventor: Paul Embree, Irvine, Calif.

[73] Assignees: Sony Corporation, Tokyo, Japan; Sony Pictures Entertainment, Culver City, Calif.

[21] Appl. No.: 561,993

[22] Filed: Nov. 22, 1995

[51] Int. Cl.[6] ..... H04R 5/00

[52] U.S. Cl. ..... 381/22; 381/19

[58] Field of Search ..... 381/18–23, 1

[56] References Cited

U.S. PATENT DOCUMENTS

| | | | |
|---|---|---|---|
| 3,864,516 | 2/1975 | Kameoka et al. | 381/22 |
| 3,944,735 | 3/1976 | Willcocks | 381/20 |
| 3,970,788 | 7/1976 | Cooper | 381/23 |
| 4,862,502 | 8/1989 | Griesinger | 381/22 |
| 5,046,098 | 9/1991 | Mandell et al. | 381/22 |
| 5,216,718 | 6/1993 | Fukuda | 381/18 |
| 5,524,054 | 6/1996 | Spille | 381/18 |

*Primary Examiner*—Curtis Kuntz
*Assistant Examiner*—Ping W. Lee
*Attorney, Agent, or Firm*—Jerry A. Miller; Charles J. Kulas

[57] ABSTRACT

A digital surround sound decoder. The decoder uses an architecture including two signal processing chips to achieve a program that can decode audio data at sufficiently high resolution. The decoder performs in real time and is compatible with standard surround sound formats. The decoder includes software that utilizes table lookups for critical functions in the decoding process. The processing flow of the decoder's program takes advantage of the multi-function capability within the specific processors used in the design while using a minimum number of program instructions. The program implements band pass filtering, sum-difference calculations, fast-attack slow-decay integration, summation and reciprocal processing, determination of fast and slow modes, look-up table indexing, adaptive matrix processing and various other functions to generate decoded surround sound signals from encoded left and right signal inputs.

2 Claims, 14 Drawing Sheets

FIG. 7A

```
#define    LUT_SIZE 350
#define    SCALE_Y 1000.0
#define    CLIP_Y (LUT_SIZE-1)

.extern_delay_length,_delay_buffer,_delay_ptr;

.segment/dm seg_dmda;
.var _lrcs_in[4];

/* L R C S sum (LRCS)  */
.var _srnd_fasd_outputs[5] = 0.0, 0.0, 0.0, 0.0, 0.0;
.var _srnd_fasd_ratios[5] = 0.0, 0.0, 0.0, 0.0, 0.0;

/*                              FAST ATTACK     SLOW DECAY  */
.var _srnd_fasd_coefs[8] =  9 . 600054e-001,  9 . 962214e-001,
                            9 . 600054e-001,  9 . 962214e-001,
                            9 . 600054e-001,  9 . 962214e-001,
                            9 . 600054e-001,  9 . 962214e-001;
/* time constants:              1.0 msec          6.0 msec  */

/* Added "FAST" mode 11-4-95 */
/*                              FAST ATTACK     SLOW DECAY  */
.var _srnd_fasd_ratio_coefs[16] = 9 . 9434710e-001, 9.9981105e-001,
                            9 . 943471e-001,  9 . 9981105e-001,  /*  120 msec  */
                            9 . 943471e-001,  9 . 9999055e-001,  /*  240 msec  */
                            9 . 943471e-001,  9 . 9962214e-001,  /*  60 msec  */
/* fast time constant:          4.0 msec ^^ */
                            9 . 924699e-001,  9 . 962214e-001,   /*  3,6 msec  */
                            9 . 924699e-001,  9 . 962214e-001,   /*  3,6 msec  */
                            9 . 924699e-001,  9 . 962214e-001,   /*  3,6 msec  */
                            9 . 924699e-001,  9 . 962214e-001,   /*  3,6 msec  */

.var _lut_C[2*LUT_SIZE] = *ctab.dat";

_lut_L:
.var _lut_R[2*LUT_SIZE] = "rtab.dat";

.var _lut_S[2*LUT_SIZE] = "stab2.dat";

.var _srnd_dline_ch0[2] = 0.0, 0.0;                    {   w``, w`   }
.var _srnd_dline_ch1[2] = 0.0, 0.0;                    {   w``, w`   }

.var cntl[6] ;    /* int control signals,  L, R, C, S, CS combined */
.var fcntl[5] ;    /* float control signals,  L, R, C, S, sum (LRCS) */

.endseg;

.segment/pm seg_pmda;
{  a2,  a1,  b2,  b1,  gain}
/* gain value will not be used because control is based on ratios  */
.var_srnd_filter_coefs[5] = -4 . 8552989e-01,  1 . 4726345,  -1 . 0000000,  0.0,  2 . 5723505e-001;
.endseg;

.global _lut_C, _lut_L, _lut_R, _lut_S;
.global _srnd_fasd_coefs, _srnd_fasd_outputs, _srnd_fasd_ratios;

.segment/pm.seg_pmco;
.global _srnd;
```

FIG. 7B

```
_srnd:

550 /* filter Lin */
    /* gain value will not be used because control is based on ratios */
       b8=_smd_filter_coefs;   { circ coef pointer }
       b0=_smd_dline_ch0;   { delay line pointer }
    554                                          { w` = w(n-1), w ``= w(n-2) }
       F9=pass F0,                F2=dm (I0, M1) , F4=pm(I8, M8) ; { get Lin, rd w ``,        rd a2}
       F12=F2*F4,                 F3=dm (I0, M7) , F5=pm(I8, M8) ; { w` `a2, rd w `,    rd a1}
       F12=F3*F5,  F9=F9+F12,     dm(I0, M1)+F3,  F6=pm(I8, M8) ; { w` al,  x+w``a2,    wr new w`,
       F12=F2*F6,  F9=F9+F12,                     F7=pm(I8, M8) ; { w` `b2,  new w, rd b1}
       F12=F3*F7,  F9=F9+F12,     dm(I0, M1)+F9,                  { w` b1,  new w+(w ``b2), wr new w

552 /* filter Rin (in f8), delay line assumed after previous one */
    /* gain value will not be used because control is based on ratios */

                   F11=F9+F12     F2=dm(I0, M1) ; {calc left, rd w ``            }
       F12=F2*F4,                 F3=dm(I0, M7) ; {w ``a2,    rd w `  }
       F12=F3*F5,  F10=F8+F12,    dm(I0, M1)=F3 ; {w `a1, x+w ``a2, wr new w `   }
       F12=F2*F6,  F10=F10+F12 ;                  {w ``b2,    new w }
       F12=F3*F7,  F10=F10+F12 ; dm(I0, M1)=F10 ; {w `b1, new w+(w``b2) , wr new w  }
                   F10=F10+F12 ;                  { calc right }

    /* original Rin still in F8, filtered Rin in F10 */
    /* original Lin still in F0, filtered Lin in F11 */

    /* calculate matrix for filtered signals */

    /* Filtered: f11 = Lin, f10 = Rin,  fl = Cin,  f3 = Sin */
556    f1 = f11 + f10, f3 = f11 - f10 ;      /* form Cin and Sin */

    /* calculate control signals from filtered 1rcs */
    /* FASD for r, I, Cin, Sin, accumulate results in f11 */
       I1 = _smd_fasd_coefs;
       I0 = _smd_fasd_outputs;                                  /*store/read past results */
       f7=0 . 7071067811865 5;                                  /* load 1/sqrt(2) */
       f1 = f1*f7, F12=ABS F11,   F9=dm(I0,1) ;                 /*C*0 . 707 , abs(L) , rd y1 ' */
558    f3 = f3*f7, F2=F9-F12,     F4=dm(I1,2) ;                 /* S*0 . 707,y1'-|x| , rd coef[0] */
       IF GE R2 = PASS R2,        F4=dm(-1, I1) ;               /* if TRUE rd coef [1] */
       F9 = F2*F4;
       F13 = F9 + F12,            F9=dm(I0, -1) ;               /* add |x|, rd y2 ' */
       F12+ABS F10,               dm(I0, 2)+F13 ;               /* abs(r), wrt y1 */
       F2 = F9 - F12,             F4=dm(I1, 2) ;                /* y2; - |x|, rd coef[0] */
       IF GE R2 + PASS R2,        F4=dm(-1, I1) ;               /* if TRUE rd coef [1] */
       F9 = F2*F4,F6=dm(-2, I0) ;
       F11 = F9 + F12,            F9=dm(I0, -1) ;               /* add |x|, rd y3 ; */
       F12 = ABS F1,              dm(I0, 2)=F11 ;               /* abs (C), wrt y2 */
       F2 = F9 - F12,             F4=dm(I1, 2) ;                /* y3; - |x|, rd coef [0] */
       IF GE R2 = PASS R2,        F4=dm(-1, I1) ;               /* if TRUE rd coef [1] */
       F9 = F2*F4, F11=F11+F13,   F7=dm(-2, I0) ;               /* add y1, y2 */
       F13 = F9 + F12,            F9=dm(I0, -1) ;               /* add |x|, rd y4' */
       F12 = ABS F3,              dm(I0, 1)=F13 ;               /* abs (S), wrt y3 */
       F2 = F9 - F12,             F4=dm(I1, 2) ;                /* y4' - |x|, rd coef [0] */
       IF GE R2 = PASS R2,        F4=dm(-1, I1) ;               /* if TRUE rd coef [1] */
       F9 = F2*F4, F14=F11+F13,   F5=dm(-1, I0) ;               /* add y3 */
       F10 = F9 + F12,                                          /* add |x|,  */
       F11 = F10 + F14,           dm(I0, 1)=F10 ;               /*       add y4, wrt y4 */
                                                                /* F11 = sum(y1, y2, y3, y4) */
```

FIG. 7C-1

```
/* outputs from FASD    /
/* r6<>L   r7<>R   r5<>C   r10<>S   */

562 /* find SCALE_Y/(sum(r+1+s+c)/4)        */
        F4=4 . 0*SCALE_Y ;
    /* divide code, form f0=f4/f11 */
        f9=2 . 0 ;                      /* required for divide */
        f2=recips f11 ;                 /* 8 bit seed, R0 */
        if av f2 = f9-f9 ;
        f12=f2*f11 ;                    /* D'=D*R0 */
        f4=f2*f4, f2=f9-f12 ;           /* R0*N, R1=2-D' */
        f12=f2*f12 ;                    /* D'=D' *R1 */
        f4=f2*f4, f2=f9-f12 ;           /* N*R0*R1, R2=2-D' */
        f3=f2*f4 ;                      /* N*R0*R1*R2 */

/* outputs from FASD */
/* f6<>L   f7<>R   f5<>C   f10<>S   */

564 /* scale all control signals and subtract 1.25*SCALE_Y */
    /* F3 is SCALE/sum(y1, y2, y3, y4) */
        f12=1.25*SCALE_Y;
        f9=f3*f5,   r13=M7;             /* f13=-1, used to count >0 controls */
        f9=f3*f6,   f5=f9-f12;
        IF GT r13=r13+1;                /* check > 0 control */
        f9=f3*f7,   f6=f9-f12;
        IF GT r13=r13+1;                /* check > 0 control */
        f7=f9-f12;

        IF GT r13=r13+1;                /* check > 0 control */
        f9=f3*f10;
```

FIG. 7C-2

```
/*  calculate control signals from ratio of filtered 1rcs */
/*  FASD for r, 1, Cin, Sin ratios */
    I1 = _srnd_fasd_ratio_coefs;
    I0 = _srnd_fasd_ratios;                                  /* store/read past results */

    f10=f9-f12;                  /* last control signal calc here saves cycle */
    IF GT r13=r13+1;                /*    check > 0 control */
    r13 = pass r13;

    IF GT F9=dm(I1,8);              /*    move to fast coefs with dummy read */

    F12=PASS F6,                 F9=dm(I0, 1);        /* (L), rd yl' */
    F2 =F9 - F12,                F4=dm(I1, 2);        /* yl'-x, rd coef[0] */
    IF GE R2 = PASS R2,          F4=dm(-1, I1);       /* if TRUE rd coef [1] */
    F9 = F2*F4;
    F6 = F9 - F12,               F9=dm(I0, -1);       /* add x, rd y2' */
    if LT F6 = F6-F6;                                 /* clip yl at 0 */
    F12=PASS F7,                 dm(I0, 2)=F6;        /* (R), wrt yl */
    F2 =F9 - F12,                F4=dm(I1, 2);        /* y2'-x, rd coef[0] */
    IF GE R2 = PASS R2,          F4=dm(-1, I1);       /* if TRUE rd coef [1] */
    F9 = F2*F4;
    F7 = F9 + F12,               F9=dm(I0, -1);       /* add x, rd y3' */
    if LT F7 = F7-F7;                                 /* clip y2 at 0 */
    F12=PASS F5,                 dm(I0, 2)=F7;        /* (C), wrt y2 */
    F2 =F9 - F12,                F4=dm(I1, 2);        /* y3'-x, rd coef[0] */
    IF GE R2 = PASS R2,          F4=dm(-1, I1);       /* if TRUE rd coef [1] */
    F9 = F2*F4;
    F5 = F9 + F12,               F9=dm(I0, -1);       /* add x, rd y4' */
    if LT F5 = F5-F5;                                 /* clip y3 at 0 */
    F12=PASS F10,                dm(I0, 2)=F5;        /* (S), wrt y3 */
    F2 =F9 - F12,                F4=dm(I1, 2);        /* y4'-x, rd coef[0] */
    IF GE R2 = PASS R2,          F4=dm(-1, I1);       /* if TRUE rd coef [1] */
    F9 = F2*F4;
    F13 = F9 + F12,                                   /* add x */
    if LT F13 = F13-F13;                 /*           clip y4 at 0 */
    r13=fix f13,          dm(I0, 1)=F13; /*  wrt y4 */
```

566

FIG. 7D

```
/* c ontrol signals r5-r8 from filtered 1rcs */

/* outputs from FASD */
/* R6<>L   r7<>R   r5<>C   r13<>S   */

/* here we calculate i3-i6 from control signals r6, r7, r5, 513 */
/* i3<>r5<>C   i4<>r6<>L   i5<>r7<>R   i6<>r13<>S */
   r11=CLIP_Y;
   r13=MIN(r13, r11); /* S */
   r7=fix f7, i6=r13;
   r13=MIN(r7, r11); /* R */
   MODIFY(i6,_lut_S);
567 r13-r13+r13;        /* double here for double entry LUTs */
   r6=fix f6, i5=r13;
   r13=MIN(r6, r11); /* L */
   MODIFY(i5,_lut_R);
   r13=r13+r13;        /* double here for double entry LUTs */
   r5=fix f5, i4=r13;
   r13=MIN(r5, r11); /* C */
   MODIFY(i4,_lut_L);
   r13=r13+r13;        /* double here for double entry LUTs */
   i3=r13;
   f10=0.70710678118655;                    /* load 1/sqrt(2) */
   MODIFY(i3,_lut_C);

/* original Rin still in F8 */
/* original Lin still in F0 */

/* calculate matrix for original input signals:
   f0 = Lin,   f8 = Rin,   f1 = Cin,   f2 = Sin */
   f1 = f0 + f8, f2 = f0 - f8, f12=f10;          /* form Cin and Sin */
   f1 = f1*f10, f3 = f8;                         /* move Rin to f3 */
   f2 = f2*f10, f4 = dm(I3, M1);                    /* get c1 */
   f15=f1*f4,  f10=f10+f12, f4 = dm(I4, M1);     /* Cin*c1, get 11, 3dB */
   f13=f0*f4,  f4 = dm(I4, M1);                  /* Lin*11, get 12 */
568 f11=f0*f4,  f4 = dm(I5, M1);                  /* Lin*12, get r1 */
   f14=f3*f4,  f9 = f11+f15,  f4=dm(I5, M5);     /* Rin*r1, form Cout, get r2 */
   f15=f3*f4,  f4 = dm(I3, M5);                  /* Rin*r2, get c2 */
   f9 =f1*f4,  f0 = f9+f15,  f4=dm(I6, M5);      /* Cin*c2, form Cout, get s2 */
   f14=f2*f4,  f8 = f9+f14;                      /* Sin*s1, form Rout */
   f6 = f8  - f14;                               /* form Rout */
   f9 = f9 + f13,                                /* form Lout */
   f9 = f9 + f14, f4 = f12;                 /* form Lout, load 1/sqrt(2) */
   f14=f2*f4,  f8 = f11-f15;                     /* Sin/sqrt(2), form Sout */
   L0=dm(_delay_length );
   B0=_delay_buffer;
   I0=dm(_delay_ptr);
   f1 = f8 + f14;                                /* form Sout */
570 f1=f1*f10,  f8=dm(0,I0);                     /* 3dB boost, delayed Sout */
   dm(I0, 1)=f1;                                 /* save un-delayed Sout */
   rts (db);
   dm(_delay_ptr)=i0;
   10 = 0;
.endseg;
```

DIGITAL SURROUND SOUND PROCESSOR

COMPUTER CODE

This application includes Figures and an Appendix containing computer language source and object code and data (©1995 Sony Cinema Products Corporation). A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD OF THE INVENTION

This invention relates generally to digital signal processing and specifically to a digital signal processor for decoding a surround sound format.

BACKGROUND OF THE INVENTION

"Surround sound" is a term used in audio engineering to refer to sound reproduction systems that use multiple channels and speakers to provide a listener with simulate placement of sound sources. Typically, the listener is positioned between multiple speakers. By playing a sound at different intensities through one or more of the speakers, the sound is positioned with respect to the listener. In this way the listener may be "surrounded" with sound sources to create a more interesting or realistic listening experience. The device that plays back recorded audio signals through the speakers to achieve the surround sound effect is called a surround sound decoder.

Surround sound decoders are a common device in commercial movie theaters since surround sound is especially well-suited as a movie audio effect. By using surround sound along with a theater's large projection screen, an audience can be more completely immersed in the movie experience. Speakers toward the from of the theater, sometimes behind the screen itself, can localize sound to the right, left or center of the screen so that, for example, a movie character's voice can appear to come from the approximate position of the character on the screen. Additional speakers to the sides of the theater can be used to create sounds that are intended to be at the extreme sides of the screen or off-screen. Other popular locations for surround sound speakers are at the back and ceiling of the theater.

Surround sound decoders are also becoming more common in the consumer retail market. With the growing popularity of home entertainment centers, many consumers are creating high quality theater-like image and audio centers within their homes. Surround sound audio capability is one of the advanced features installed in such entertainment centers.

As a result of the success of surround sound in the theater and home markets the need for accurate, efficient and cost effective surround sound devices is increasing. Further, the audio processing technology in both theater and home systems has become increasingly digital. This places a burden on the surround sound decoder to meet the high quality specifications of digital audio processing such as low noise and wide dynamic range. However, typical surround sound decoders use analog components which fail to achieve the fidelity of today's digital audio. Also, the use of analog components in surround sound decoders causes the decoders to be sensitive to thermal effects and to decode inaccurately in some cases. The attempts to produce analog circuits that compensate for analog deficiencies require using high precision components, or adding additional circuitry to the decoder design, resulting in a more expensive decoder.

FIG. 1A shows an arrangement of speakers in a typical 4 channel surround sound system 100. Speakers 102, 104 and 106 play left ("L"), center ("C") and right ("R") channels, respectively. Speakers 108 and 112 are two speakers used to play the surround channel ("S"). Listening area 110 is positioned approximately in the middle of the speakers. In a cinema application, the movie screen (not shown) would be adjacent to, and parallel with, the left, center and right speakers.

The speakers are driven by channel signals generated by decoder 114. Decoder 114 derives the channel signals from a sound source signal generated by sound source 116. Sound source 116 may be a movie projector, compact disk ("CD"), laser disk, video tape, etc. A common format provides for the sound source to output two signals as left and right stereo signals to decoder 114. The decoder operates according to a surround sound format that specifies how the four L, R, C and S signals are encoded onto, and decoded from, the two stereo signals. One such format is promulgated by Dolby Laboratories and known as Dolby Pro Logic Surround. For a description of this surround sound format, and associated analog decoder, refer to papers published by Dolby Laboratories such as "Dolby Pro Logic Surround Decoder Principles of Operation," by Roger Dressier; 1988, 1993, reference no. S93/8624/9827.

FIG. 1B is a block diagram of a prior art analog surround sound decoder 120 such as that described in the reference above. Stereo inputs $L_{in}$ and $R_{in}$ at 122 are provided to the decoder from a signal source. According to the surround sound format, the stereo signals not only contain the standard left and right stereo signals, but are encoded with center and surround signal information. The center signal is encoded onto the SL and SR signals by dividing the center signal equally among $L_{in}$ and $R_{in}$. In other words, the center signal is attenuated by 3 dB and added to each of the $L_{in}$ and $R_{in}$ signals. In contrast, the surround signal is phase encoded onto the stereo signals after first being band limited from 100 Hz to 7 kHz and processed with noise reduction encoding. The left stereo signal is added with the surround signal phase shifted by plus 90 degrees while the right stereo signal is added with the surround signal phase shifted by minus 90 degrees.

This encoding format provides for complete separation between the left and right signals. The surround signal is recovered by taking the difference between the left and right stereo signals. The center signal is recovered by adding the left and right stereo signals, thus cancelling the surround components which are 180 degrees out of phase.

Returning to FIG. 1B, the stereo signals $L_{in}$ and $R_{in}$ are decoded by passing the signals through bandpass filters 124 to remove strong low-frequency and high-frequency signals that may interfere with the decoding. Signals L and R are derived, as a result. A circuit at 126 sums L and R to generate the center signal, C. Circuit 128 subtracts L and R to generate the surround signal, R. Full wave rectifier circuits 130–136 are used to generate a direct current ("dc") voltage for each of the respective signals SL, SR, center and surround. These dc voltages are used to compute a log difference for each of the pairs SL/SR and center/surround by log-difference amplifier circuits 138 and 140.

The outputs of log-difference amplifier circuits 138 and 140 are dual polarity signals. The SL/SR dual polarity signal indicates that the left channel is dominant if the signal is, for example, positive. When the signal is negative it indicates that the right channel is dominant. The detection of a dominant signal is important to surround sound processing because of a human listener's tendency to focus on a single dominant sound. For this reason, the placement of sounds in the surround sound decoding and playback is heavily dependent on a dominant sound in the sound track. If a dominant sound is to come from the left, the quality and intensity of the right, center and surround channel outputs may be sacrificed to provide for a clear left originating sound.

Similar to the SL/SR dual polarity signal, the full wave rectifier circuits 134 and 136 and the log-difference amplifier circuit 140 output a center/surround dual polarity signal that indicates, in one polarity, that the center channel dominates and, in the other polarity, that the surround channel dominates.

The amplitudes of both of the SL/SR and center/surround dual polarity signals indicate to what degree the dominant signal of the pair dominates. A feature of the surround sound circuit is that it operates differently depending on the relative dominance of signals. If the dominance of a dual polarity signal exceeds a threshold level then the surround sound circuit switches from a slow mode to a fast mode of operation. This switching is performed in the dual time constant circuits 144 and 146 under the control of threshold switch circuit 142. The dual time constant circuits Polarity splitter circuits 148 and 150 resolve the dual polarity dominance signals into four dominance control signals, or voltages, $E_L$, $E_R$, $E_C$ and $E_S$. These control voltages are used to control eight voltage controlled amplifiers ("VCAs") 152, to amplify or attenuate the SL and SR signals. Thus, VCAs 152 output eight sub-term signals corresponding to SL and SR amplified according to each of the four control voltages.

The eight sub-term signals, along with the original SL and SR signals, are provided as inputs to combining network 154. Combining network 154 derives the left, right, center and surround signals from SL and SR and adjusts the strength of each of the signals according to the 8 sub-term signals. The surround signal is passed through filter 156, time delay 158, low pass filter 160 and noise reduction circuitry 162 before being output as the S channel signal. The left, right, center and surround signals may be subjected to balance, gain or other adjustments before being output as the L, R, C and S channel signals.

Although the analog surround sound decoder circuit of FIGS. 1A and 1B is adequate to perform surround sound decoding, the circuit requires the use of matched and calibrated analog components to perform sensitive functions such as the decoding of SL+SR and SL−SR signals. Also, because of the dual and quad nature of signal paths whose relative outputs play a large role in determining the circuit's operation any differences in the functional parameters of components in the paths could cause errors in the decoding. The circuit is also susceptible to all of the shortcomings of analog circuitry used in audio applications such as the introduction of noise, different characteristics of the circuit due to environmental (especially thermal) effects, non-uniform frequency response, etc.

Thus, it is desirable to produce a digital surround sound decoder. However, the successful design of a digital surround sound decoder is difficult since the accuracy and speed needed to process an audio signal at high resolution requires a high data throughput and a large number of instructions per second in the digital signal processing ("DSP") program. Further, to be useful the digital surround sound decoder must be compatible with existing surround sound formats.

SUMMARY OF THE INVENTION

The present invention is a digital surround sound decoder that decodes a common surround sound format in real time.

In one embodiment a method for performing digital surround sound decoding in a system including a processor coupled to a memory is disclosed. The memory includes lookup tables having parameter values. The system is provided with digitized left and right audio signal data, including encoded center and surround signal data, the method comprises the steps of deriving left, right, center and surround values from the digitized left and right audio signal data; forming indexes from the left, right, center and surround values for indexing the lookup tables; retrieving parameter values from the lookup tables according to the derived indexes; and combining the retrieved parameter values with the left, right, center and surround values to generate decoded left, right center and surround channel signals.

BRIEF DESCRIPTION OF THE DRAWINGS

FIG. 7A shows data definitions and declarations for local variables and values used in the calculations in the source code;

FIG. 7B is a first set of source code instructions;

FIG. 7C is a second set of source code instructions;

FIG. 7D is a third set of source code instructions;

DETAILED DESCRIPTION OF A PREFERRED EMBODIMENT

Figure 2:
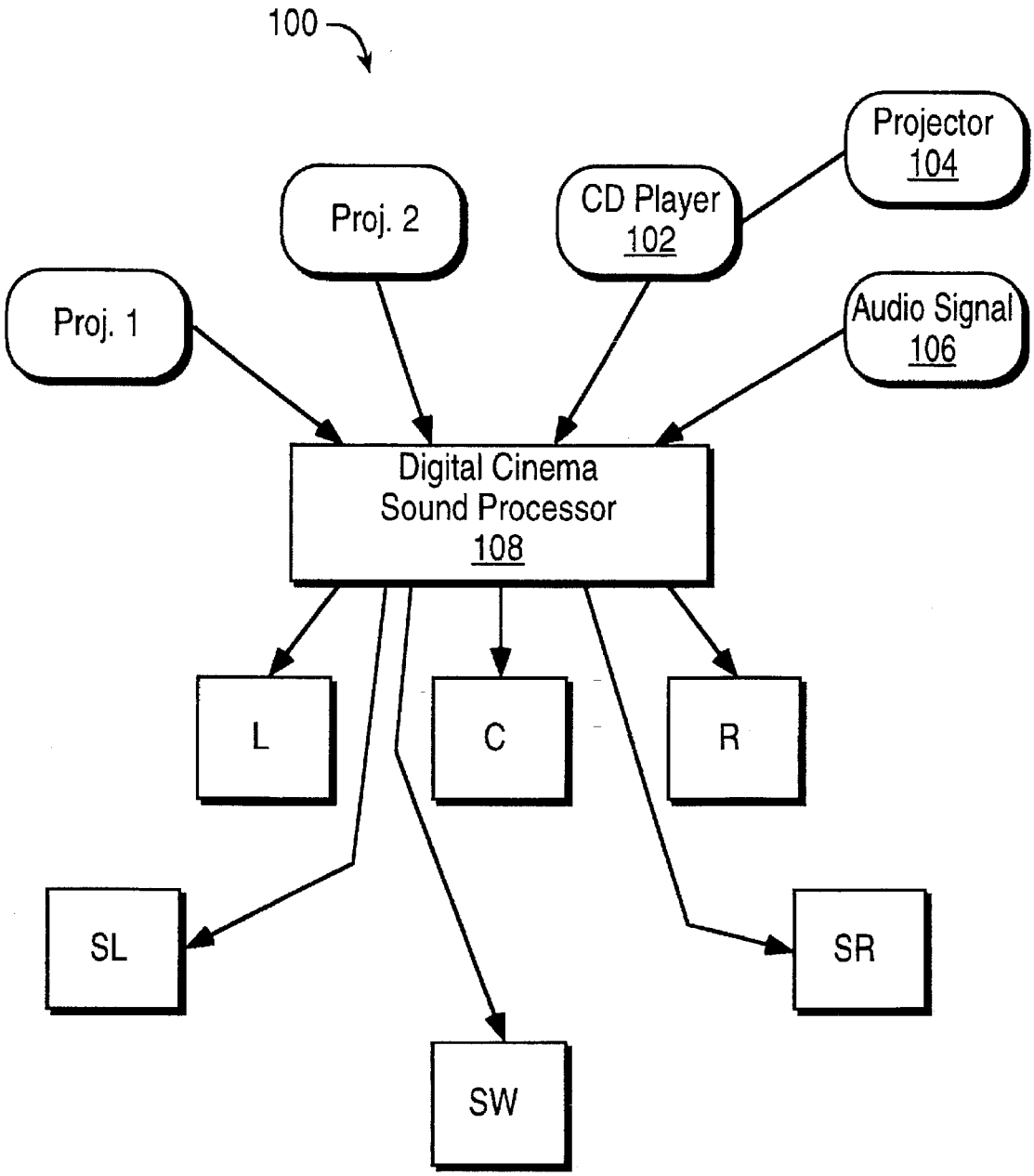
FIG. 2 is a diagram illustrating the inputs and outputs of a digital cinema sound processing system that uses the digital surround sound processing of the present invention.

FIG. 2 is a diagram illustrating the inputs and outputs of a digital cinema sound processing system that uses the digital surround sound processing of the present invention. In FIG. 2, system 100 is shown having digital cinema processor ("DCP") 108 with inputs from Projector 1, Projector 2, compact disc ("CD") player 102, projector 104 and audio signal source 106. A preferred embodiment of the present invention uses a digital cinema processor known as the DCP-1000 manufactured by Sony Corporation. A co-pending patent application Ser. No. [TO BE DETERMINED; DOCKET NO. 50J1349; ENTITLED "CONFIGURABLE DIGITAL CINEMA PROCESSOR"] 08/544,353 describes the entire functionality of this product. The surround sound processing of the DCP is the primary subject of this specification.

DCP 108 accepts inputs from photoelectric cells commonly used as transducers in movie projectors such as Projector 1, Projector 2 and Projector 104. Photoelectric cells in the projectors are used to convert an optical track on the film into electrical analog sound signals. The DCP then converts the analog sound signals to digital signals and performs digital signal processing to implement various sound modes, noise reduction formats and surround sound processing.

The outputs of DCP 108 are provided to speakers such as speakers 110–120 shown in FIG. 2. FIG. 2 shows a six speaker arrangement that is common to theaters having surround sound capability. In the surround sound arrangement, speaker 110 is the left speaker, speaker 112 is the center speaker, speaker 114 is the right speaker, speaker 116 is the left surround speaker, speaker 118 is the right surround speaker and speaker 120 is the sub-woofer. The speaker arrangement, and the number of speakers, may vary widely from that shown in FIG. 2. Also, various additional equipment may be used with the arrangement shown in FIG. 2. For example, external amplifiers and sound processing equipment may be placed between the outputs of the DCP and the speakers. Although six speakers are common, only four surround sound channels are generated, as discussed below. In the preferred embodiment, the left and right surround speakers play the same sound while the sub-woofer speaker plays filtered low frequency sounds.

Figure 3:
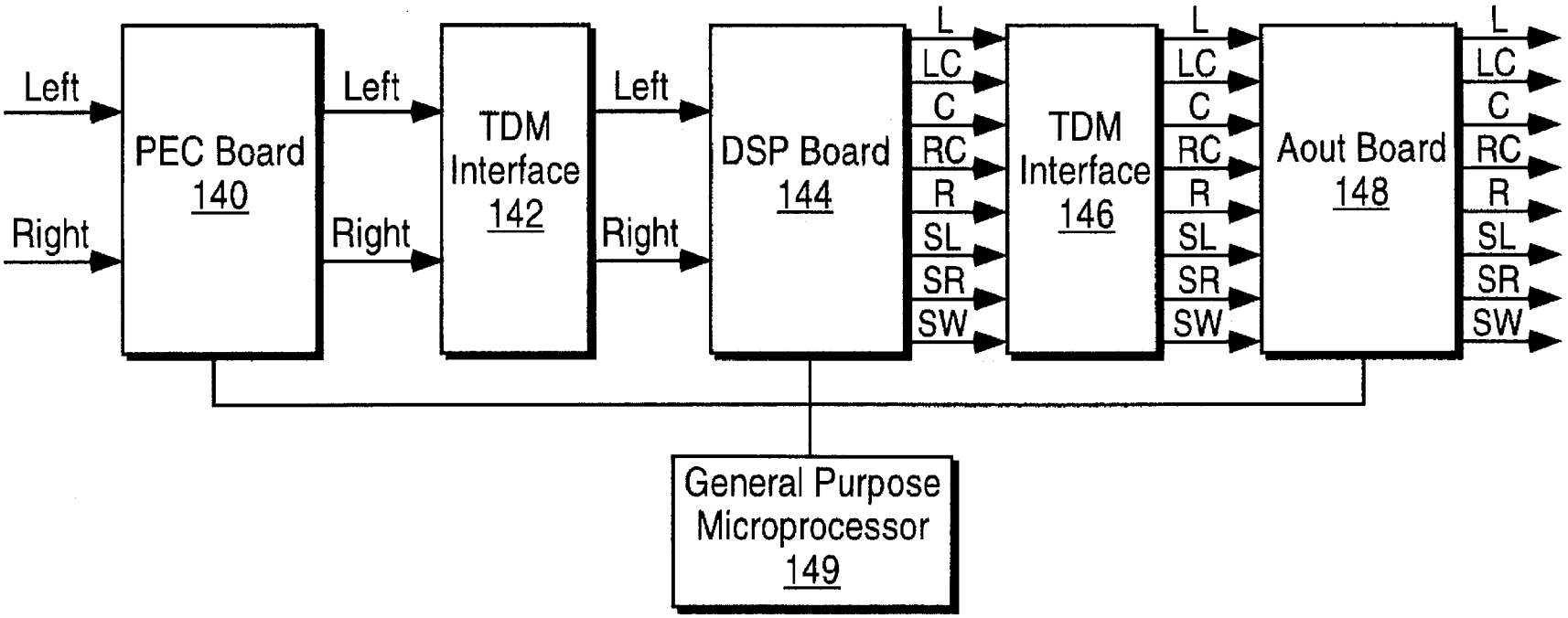
FIG. 3 shows the general path of signals through the digital cinema sound processing system.

FIG. 3 shows the general path of signals through the DCP. Signals enter the DCP from an external source such as a projector (not shown) through the PEC board 140. Typically there will be dual left/right signals from the signal source. PEC board 140 includes analog to digital ("A/D") converters to convert the left/right inputs to PEC board 140 to digital data. In the preferred embodiment the signals are assumed to be analog signals which are sampled and converted to digital data via an A/D converter. Provision can also be made for direct "digital in" signals in which case the A/D conversion may be skipped. Time division multiplex ("TDM") interface 142 is a serial data bus interface including associated controller and arbitration circuitry that accepts the digital data and distributes it to processors in digital signal processor ("DSP") board 144. Any suitable bus may be used.

DSP board 144 performs the digital signal processing necessary to implement the surround sound, noise reduction and other signal processing to achieve the desired cinema sound. The outputs of DSP board 144 are shown as digital surround sound signals L, LC, C, RC, R, SL, SR and SW corresponding to left, left center, center, right center, right, surround left, surround right and sub-woofer speaker signals. In the surround sound environment additional signals are derived from the left and right signals by adding and subtracting the left and right signals. Note that not all of these signals need be output. For example, if the sound mode is simply stereo then only L and R signals need to be output with a sub-woofer signal, if desired. Any combination of signals may be automatically selected and preconfigured since the routing and selection of L, LC, C, RC, R, SL, SR and SW signals is under software control, as discussed below.

The outputs of DCP board 144 are output to a TDM data bus for input to analog output ("Aout") board 148. Aout board 148 includes digital to analog converters to convert the digital data output from the DSP into corresponding analog signals for the speakers.

General Purpose Microcomputer 149 communicates with PEC Board 140, DSP Board 144 and Aout Board 148. Microcomputer 149 may be any suitable microprocessor system including memory, I/O, etc. In the preferred embodiment, microcomputer 149 is an International Business Machines ("IBM™") Personal Computer ("PC") based computer which performs rudimentary control and configuration operations and executes the user interface of the present invention along with processing performed by DSP board 144.

Figure 4:
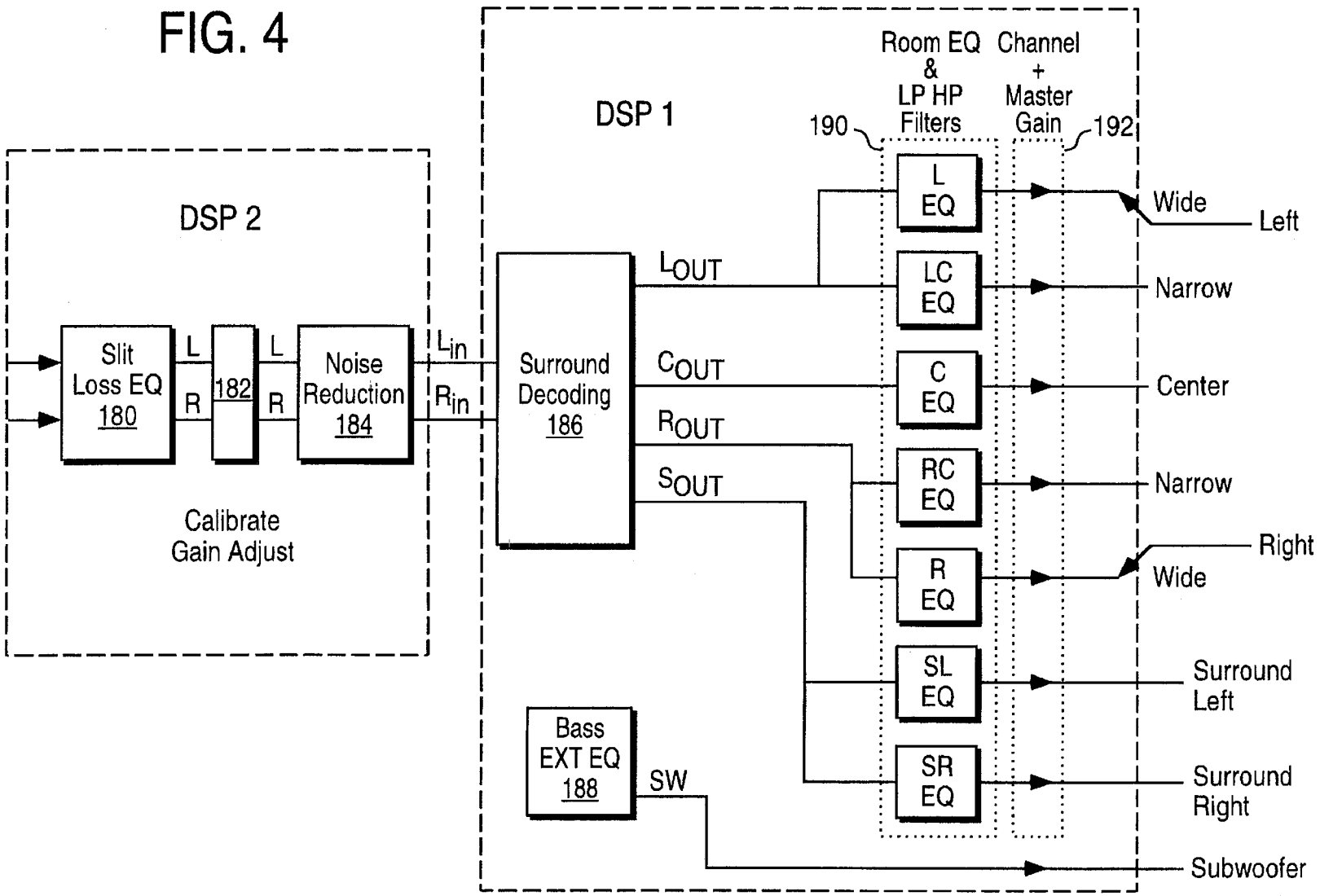
FIG. 4 shows details of the digital signal processor's signal path.

FIG. 4 shows details of the DSP signal path. In FIG. 4, functions performed by the digital signal processing of the DSP are shown as blocks. The processing is further shown as consisting of two major functional blocks labeled DSP 1 and DSP 2. In actuality, the processing is performed in the digital domain among two processors as discussed below. Because the invention uses digital signal processing there is no specific circuitry associated with any of the functional blocks shown in FIG. 4 and there is no corresponding "signal flow." Rather, the operations performed by the DSP are shown in terms of signal flow and functional blocks only for purposes of illustration and ease of discussion.

In FIG. 4, DSP 2 processing includes Slit Loss Equalization ("EQ") processing 180, Calibrate Gain Adjust processing 182 and Noise Reduction processing 184. Slit Loss EQ processing 180 attenuates and amplifies predetermined frequencies in the input signal to compensate for signal degradation due to photoelectric transduction (assuming the signal source is from a projector) and other imperfections in the signal source and associated electronics. Calibrate Gain Adjust processing 182 adjusts the signal strength.

Figure 5:
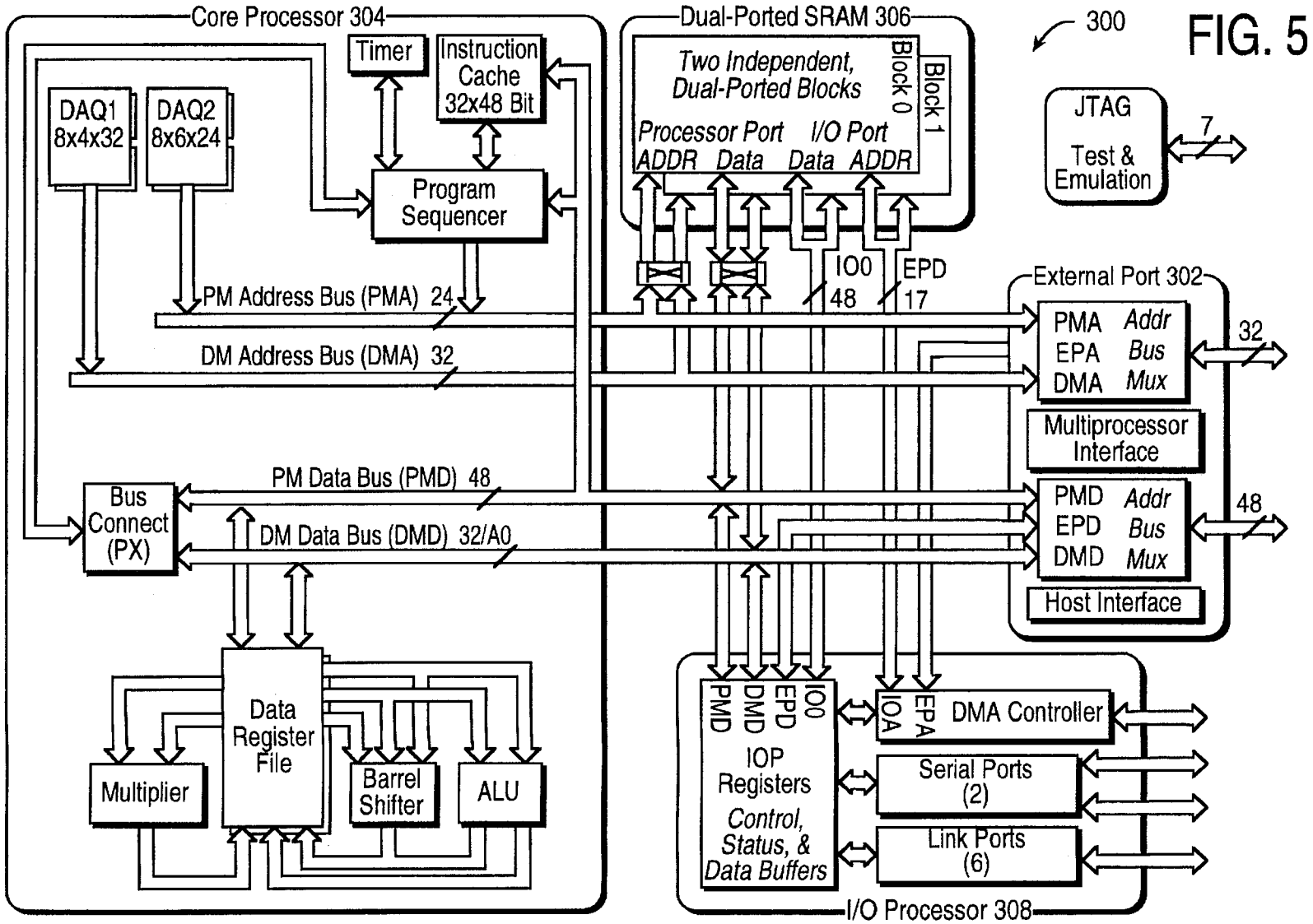
FIG. 5 is a diagram of the core processor and associated components.

FIG. 5 is a diagram of a core processor and associated components which form a processing system 300 in the DCP. In the preferred embodiment, the DCP uses two processors manufactured by Analog Devices, Inc., of Norwood Mass. The processors are part number ADSP-21062. For more information on this processor refer to the ADSP-2106x user's manual and ADSP-21060/62 Data Sheet for timing, electrical and package specifications and for details on how to program the processor. The preferred embodiment uses 32 and 40 bit floating point calculations to process the sound samples. Because floating point numbers are used, the routines that process the sound sample data are capable of maintaining high precision throughout all calculations. It should be understood that even though the numbers in this specification are given to two or three significant figures, an arbitrary precision is obtainable depending upon the limitations of the data representation and computer processing ability. The two processors in the DCP communicate via the multiprocessor interface 302 so that a multiprocessor system is achieved. This allows operations to be performed concurrently.

Logic and arithmetic functions of each processor are performed by Core Processor 304 in each of the processors. Static random access memory ("SRAM") 306 stores program code that directs the core processor to perform the digital sound processing functions of the DCP. Also, the user interface and other functions of the DCP are performed by appropriate software executed from the SRAM. Data used by the core processor, and generated by the core processor, is also stored in the SRAM. Input/Output ("I/O") functions are achieved by I/O processor 308. The architecture of processor 300 is described in detail in the references. Other processor architectures are possible. For example, while the multiprocessor architecture is especially well-suited for digital signal processing, any general purpose central processing unit ("CPU"), such as the IBM PC compatible line of CPUs, is capable of executing the user interface functions of the present invention. In the preferred embodiment, execution of program instructions to implement the user interface and configuration of the DCP is handled by both the signal processing core processors and by an IBM PC compatible CPU and associated hardware (such as memory, I/O, etc.).

Figure 6:
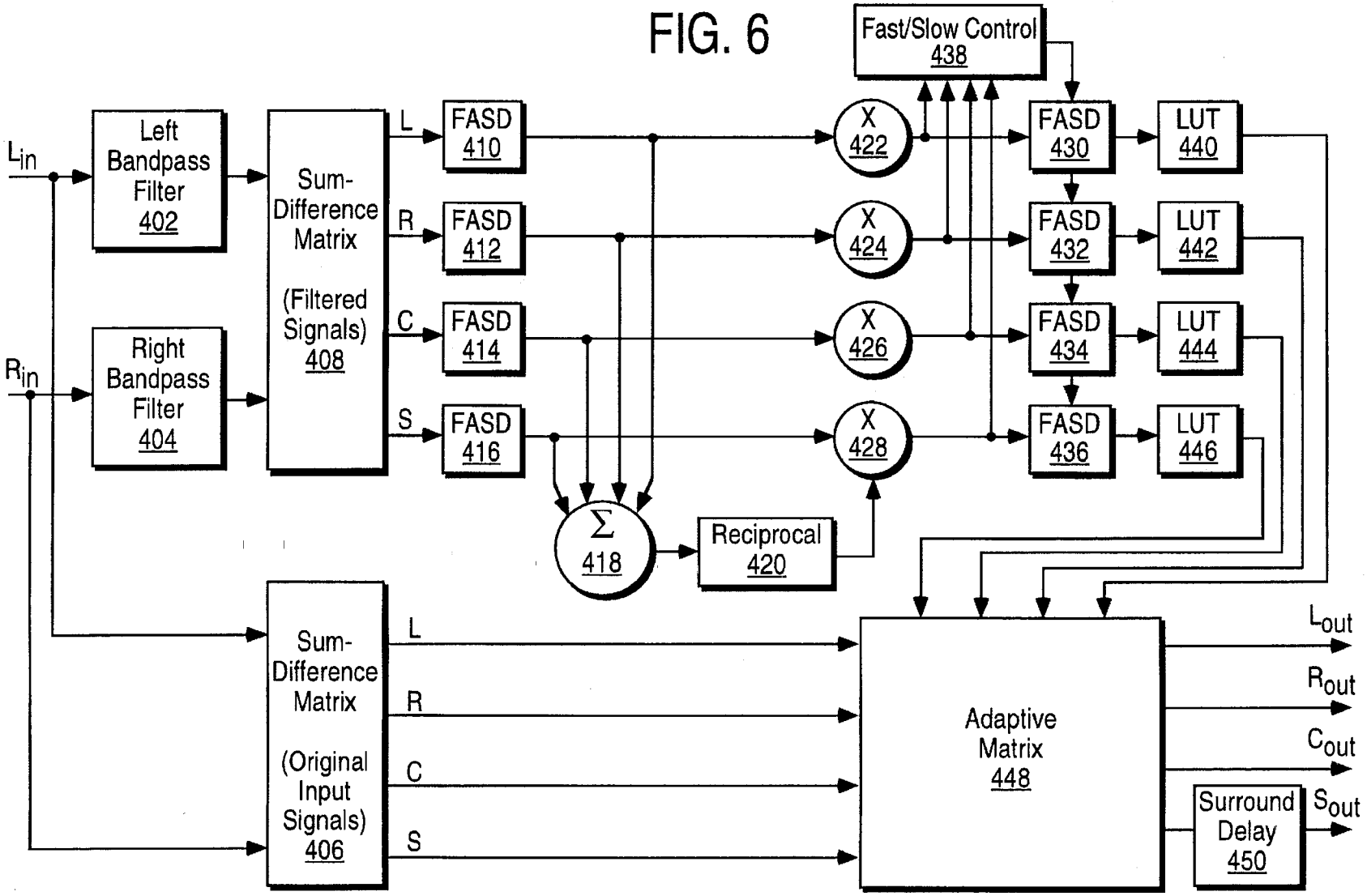
FIG. 6 illustrates the digital surround sound processing of the present invention.

FIG. 6 illustrates the digital surround sound processing of the present invention. The preferred embodiment processes digitized audio and, therefore, a schematic diagram such as FIG. 6 is only a pictorial description of the digital processing. Symbols in FIG. 6 represent functions or operations that are performed by the processor, or other component, of processor system 300 shown in FIG. 5. The functions or operations are performed under the control of programmed code such as software, firmware, microcode, etc. stored in a memory device, such as SRAM 306, and accessed and executed by core processor 304 of FIG. 5. FIG. 6 is useful to show the general sequence and flow of processing functions. That is, FIG. 6 shows the order that functions are applied to data in the preferred embodiment. Unlike an analog circuit, usually only one operation at a time is possible although the present invention provides parallelism by the processor system architecture and because two processor system chips are used in the design. Even though analog symbols and terms such as "filter" and "signal" are used to discuss FIG. 6 it should be clear that this is merely for ease of discussion. The actual source code, which is a precise description of the operation of the preferred embodiment, is shown in FIGS. 7A–D and is discussed below.

Figure 1A:
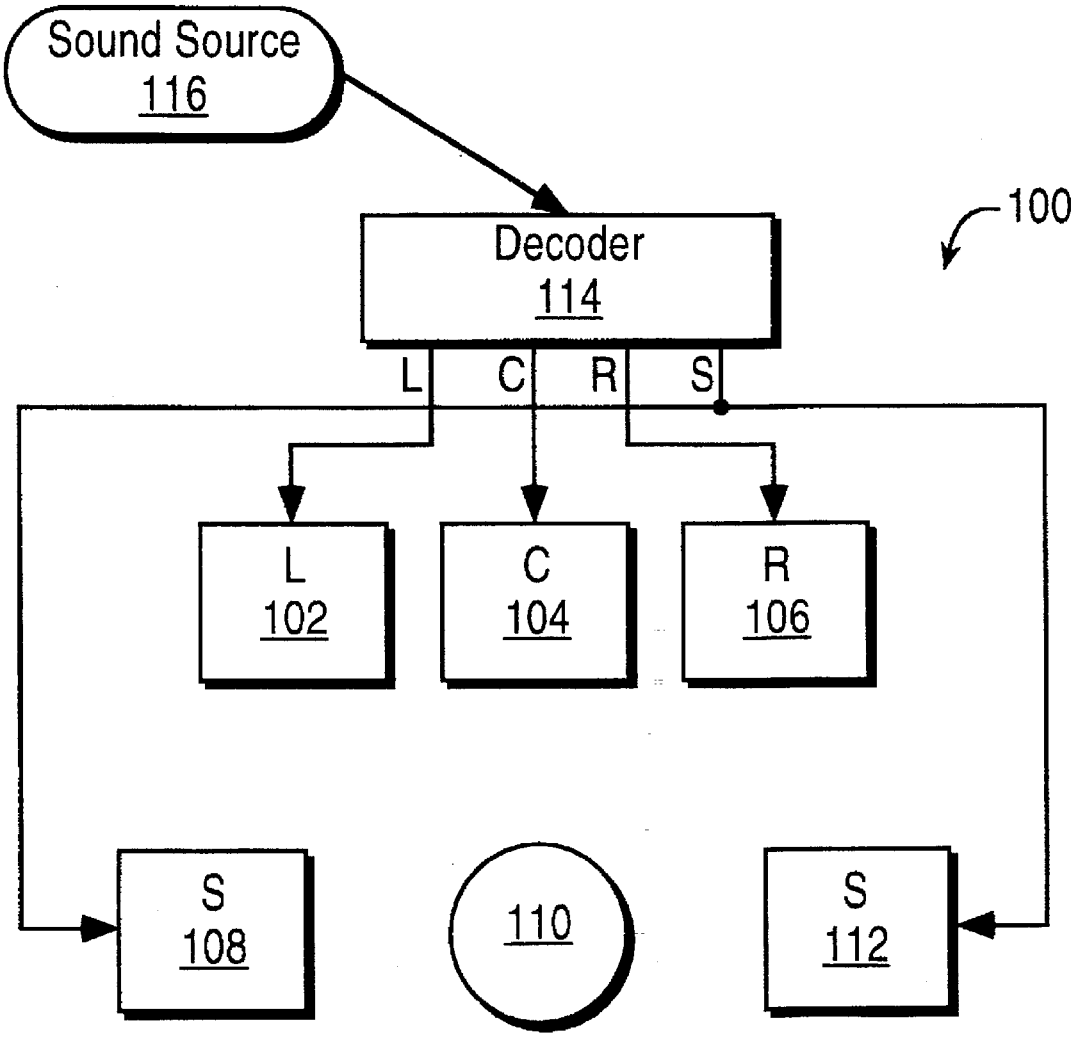
FIG. 1A (Prior Art)
FIG. 1A shows an arrangement of speakers in a typical 4 channel surround sound system.
Figure 1B:
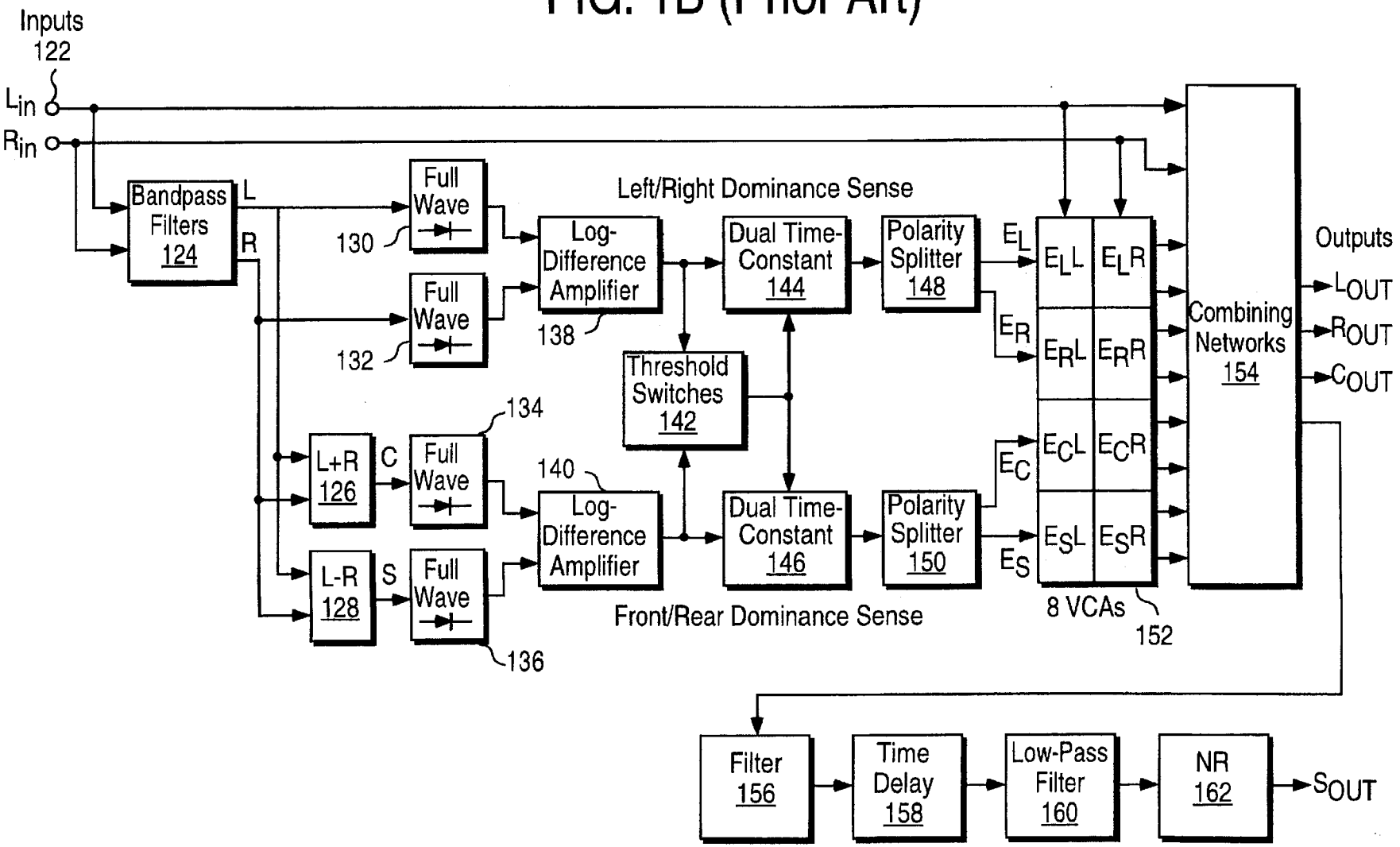
FIG. 1B (Prior Art)
FIG. 1B is a block diagram of a prior art analog surround sound decoder.

In FIG. 6, input signals $L_{in}$ and $R_{in}$ are the encoded input signals referred to as $L_{in}$ and $R_{in}$ in FIG. 1B. These signals are encoded with the standard surround sound format. The center channel signal is derived from the sum of the input signals and the surround channel signal is derived from the difference of the input signals. The derivation of center and surround signals is performed by sum-difference matrix processing 406 and 408. The inputs to sum-difference matrix 408 are first subjected to bandpass filtering to remove low and high frequency components that could interfere with the generation of dominance signals. In effect, the upper portion 454 of the surround sound processing 400 generates values analogous to the dominance control signals $E_L$, $E_R$, $E_C$ and $E_S$ of FIG. 1B.

The L, R, C and S signals from sum-difference matrix processing 406 are provided directly to adaptive matrix 448. Adaptive matrix 448 uses dominance signals, or values, from upper portion 454 to modify the L, R, C and S signals according to the dominance information to generate $L_{out}$, $R_{out}$, $C_{out}$ and $S_{out}$ signals which are accurately decoded surround sound channel signals that are used to drive multiple speakers.

In order to compute the dominance values the outputs of sum-difference matrix processing 408 are provided to fast-attack slow-decay ("FASD") processing 410–416. FASDs 410–416 provide for integrating changes in the L, R, C and S signals over time to provide a more stable response in the dominance signal processing. The time constant used for FASDs 410–416 are shown in FIG. 7A. Typical time constants can be from 0.1 to 500 mS.

Symbols 418–428 represent processing to achieve normalization of each of the L, R, C and S signals. The signal values are summed at 418, the reciprocal of the sum is taken at 420 and the result is multiplied by each of the signals at multipliers 422–428. The outputs of the multipliers represent the proportion of dominance of each of the L, R, C and S signals to the total signal strength. Each output of the multipliers is fed to a corresponding FASD 430–436. The FASDs 430–436 are adjustable under the control of fast/slow control 438. Fast/slow control 438 is used to change the time constants of FASDs 430–436 depending on the desired characteristics of the surround sound decoding. If there is only one dominant signal within a predetermined time period then slow mode time constants of between 60 to 200 mS are used in the first order FASDs. If there are two dominant signals then fast mode time constants in the range 2 to 10 mS are used. Thus, in the fast mode of operation, the surround sound processing responds more quickly to spatially move a temporarily dominant signal.

Look up tables ("LUTs") 440–446 are used to generate values for adaptive matrix 448. LUTs 440–446 are indexed with the values from FASDs 430–436 to obtain values from data tables stored in memory. The obtained values are passed to the adaptive matrix processing 448 which combines the values with the results of sum-difference matrix processing 406 to produce $L_{out}$, $R_{out}$, $C_{out}$ and S'. S' is further subjected to surround delay processing 450 and surround filter processing.

FIGS. 7A–D list the source code used in the surround sound processing in the present invention. The source code implements the calculations shown in Table I as follows:

TABLE I $$C_{out} = C_{in} * c1[C] + L_{in} * 12[L] + R_{in} * r2[R]$$
$$R_{out} = R_{in} * r1[R] + C_{in} * c2[C] - S_{in} * s2[S]$$
$$L_{out} = L_{in} * 11[L] + C_{in} * c2[C] + S_{in} * s2[S]$$
$$S_{out} = 0.707 * S_{in} + L_{in} * 12[L] - R_{in} * r2[R]$$
$$\text{where } C_{in} = 0.707 * (L_{in} + R_{in})$$
$$\text{and } S_{in} = 0.707 * (L_{in} - R_{in})$$

The above equations use LUTs to generate values for functions l1, r1 and c1 ("first functions") and for l2, r2, c2 and s2 ("second functions"), as discussed below.

FIG. 7A shows data definitions and declarations for local variables and values used in the source code of the following Figures. FIGS. 7A–D collectively show the complete program for surround sound processing. Appendix B includes object code, sometimes referred to as "binary" or "executable" code, of the executable object that is executed by the processors in the preferred embodiment.

FIG. 7B is a first Figure illustrating source code that performs the surround sound decoding. FIG. 7B includes lines at 550 that perform the left bandpass filter processing 402 of FIG. 6. Lines at 552 perform the right bandpass filter processing 404 of FIG. 6. Note that arrays and variables such as "_srnd_filter_coefs" and "_srnd_dline ch0" are defined in the statements in FIG. 7A. Line 554 includes operations such as "pass," "dm" and "pm" that are defined in the ADSP-2106x SHARC User's Manual, First Edition, 1995, Analog Devices (the "User's Manual"). The User's Manual should be consulted in conjunction with the discussion of source code of FIGS. 7A–D. The compound operations in line 554 are typical of the multifunction ability of the processor (shown in FIG. 5) used in the preferred embodiment.

Table II shows the inputs and outputs of the digital signal processing given by the source code in FIGS. 7A–D.

TABLE II

| |
|---|
| INPUTS: |
| f0 = Lin, f8 = Rin |
| m1 = 1, m5 = 0, m7 = −1 |
| OUTPUTS: |
| f0 = Lin, f8 = Rin |
| f1 = Cin, f2 = Sin |
| f0 = $C_{out}$ |
| f6 = $R_{out}$ |
| f9 = $L_{out}$ |
| f8 = $S_{out}$ |
| i3–i6 INDEXES TO TABLES DEFINED AS FOLLOWS: |
| dm(i3) = c1[C], dm (i3 + 1) = c2[C], dm(i3 + 2) = c3[C] |
| dm(i4) = l1[L], dm(i4 + 1) = l2[L] |
| dm(i5) = r1[R], dm(i5 + 1) = r2[R] |
| dm(i6) = s2[S] |

In FIG. 7B, the sum-difference matrix processing for the filtered inputs is performed at lines 556. This is the sum-difference matrix processing 408 of FIG. 6. The lines at 556 implement a 170–4850 Hz filter and form values for use with dominance processing. Next, values for four FASDs are processed at lines 558 of FIG. 7B to produce a sum of the four outputs. The processing of lines 558 corresponds to the four FASDs 410–416 and summation 418 of FIG. 6. Lines at 562 of FIG. 7C form the reciprocal corresponding to 420 of FIG. 6. Lines at 564 of FIG. 7C perform the scaling operations of multipliers 422–428 of FIG. 6. Next, the fast/slow control values are derived at lines 566 of FIG. 7C for processing of FASDs 430–436. Specifically, the instruction "f10=f9–f12" sets flags that determine whether the coef[0] (fast) or coef[1] (slow) coefficients are used. These coefficients are also given in the arrays of FIG. 7A.

Figure 8:
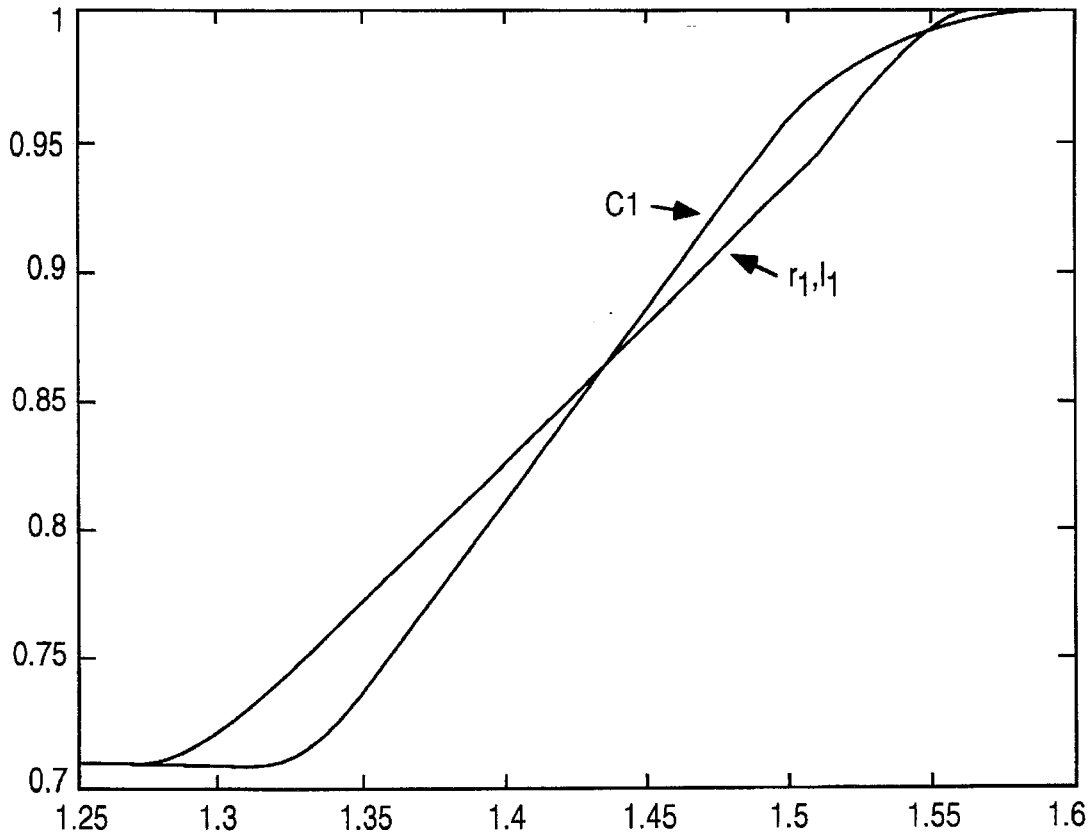
FIG. 8 shows a first set of parameter function curves.
Figure 9:
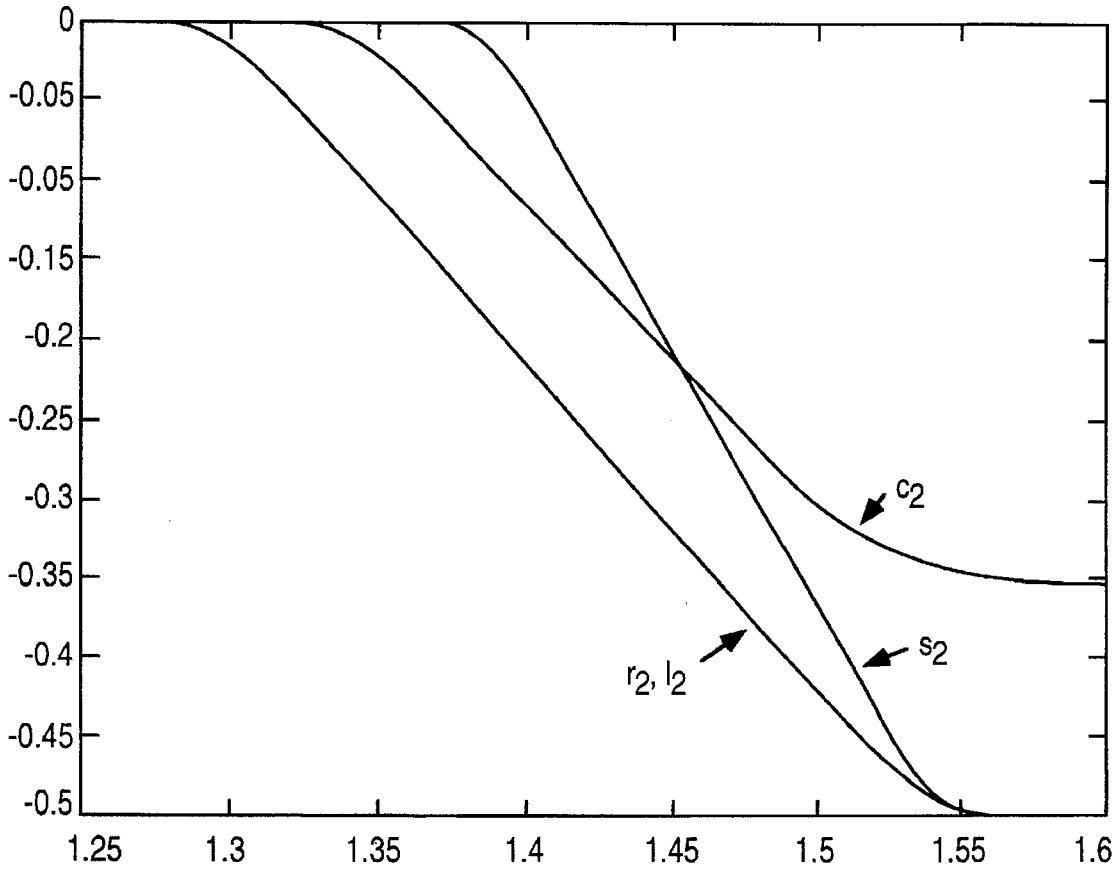
FIG. 9 shows a second set of parameter function curves.

LUT processing is performed at lines 567 of FIG. 7D. The LUT values are chosen to fit the values of the parameter function curves shown in FIG. 8 for l1, r1 and c1 ("first functions") and as shown in FIG. 9 for L2, R2, C2 and S2 ("second functions"). The curves represent functions returning a parameter value, shown along the vertical, or "y" axis, for a given argument value, or input, shown along the horizontal "x" axis. Each parameter value for the second functions is between 0 and −0.5. Each parameter value for the first functions is between 0.707 (the reciprocal of the square root of two) and 1.0. The arguments to the functions have an operational range between 1.25 and 1.6 and are scaled to produce an index for the LUTs. For example, referring to FIG. 8, a signal value of 1.5 used to index a LUT corresponding to function r1 produces a value of about 0.95. The complete LUT values used in the preferred embodiment are given in Appendix A. The values in the LUTs, and the curves of FIGS. 8 and 9, are subjective since the proper choice of values depends upon a human listener's aural impressions. Trial and error experimentation can be performed to optimize the values and improve the performance of the digital surround sound decoder.

Note that the LUT for the "right" and "center" signals, i.e., tables for r1, r2, c1 and c2, contain double entries to speed up accessing these tables.

Lines 568 and 570 show (overlapping) processing to achieve the adaptive matrix processing and surround delay processing. The adaptive matrix processing corresponds to block 448 of FIG. 6, while the surround delay processing corresponds to block 450 of FIG. 6. The adaptive matrix forms the $L_{out}$, $R_{out}$, $C_{out}$ and $S_{out}$ decoded surround sound channel signals according to the equations given above in Table I. Additional processing and modifications to the channel signals may be performed before the signals are applied to external speakers. For example, the preferred embodiment uses surround sound filtering performed digitally at block 190 of FIG. 4. The surround sound signals are equalized, filtered and separated into the six signals used to drive the speaker configuration of FIG. 2. Optional noise reduction and other processing may be performed on the signals.

Thus, a procedure for achieving digital surround sound decoding has been presented. The specific software program may be modified from the embodiment presented here. For example, instructions may be deleted from the program where certain functions (e.g., surround delay) are not desired. The order of instructions may change without appreciably affecting the performance of the overall invention. That is, although the program has been designed to execute as quickly as possible, acceptable performance may still be realized with a different, more slowly executing, program as long as the program is able to perform surround sound decoding in real time on digital samples. Instructions may be added to the program to provide additional functionality as long as the performance requirements are met. Naturally, computer architectures other than that shown in FIGS. 3 and 5 may be employed and it is likely that the program to control the computer would vary greatly from the program presented here. Although the invention has been discussed with respect to a specific embodiment, the scope of the invention is to be determined solely by the appended claims.

APPENDIX A

:\PAUL\2106X\ELD1_1\C'AB.DAT /95

```
7.0710678e-001
0.0000000e+000
7.0710678e-001
0.0000000e+000
7.0710678e-001
0.0000000e+000
7.0710678e-001
0.0000000e-000
7.0710678e-001
0.0000000e+000
7.0710678e-001
0.0000000e+000
7.0710678e-001
0.0000000e+
```

AUL\2106X\BLD1_1\CTAB.DAT 11/1

```
 7.0710678e-001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e 001
 0.0000000e+000
 7.0710678e-001
 0.0000000e+000
 7.0710678e-001
 0.0000000e+000
 7.0710678e 001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e 001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e 001
 0.0000000e+000
 7.0710678e-001
 0.0000000e+000
 7.0710804e-001
 0.0000000e+000
 7.0712602e-001
 0.0000000e+000
 7.0716633e-001
 0.0000000e+000
 7.0723097e 001
 0.0000000e+000
 7.0732181e 001
-1.7730791e-006
 7.0744051e-001
-1.0950704e 005
 7.0759025e-001
-3.9642083e-005
 7.0777609e-001
 8.9169983e-005
```

F:\PAUL\2108X\BT.D1_1\CPAB.DAT 7/95

7.0799508e-001
-1.5881276e-004
7.0824834e-001
-2.5006729e-004
7.0853694e-001
-3.6442298e-004
7.0886180e-001
-5.0332063e-004
7.0922362e-001
-6.6813473e-004
7.0962690e-001
8.6309484e-004
7.1007392e-001
-1.0912115e-003
7.1056012e-001
1.3502406e-003
7.1108578e-001
-1.6414361e-003
7.1165106e-001
-1.9680094e-003
7.1227050e-001
-2.3340126e-003
7.1296652e-001
-2.7648759e-003
7.1365782e-001
-3.2471026e-003
7.1440021e-001
3.7785362e-003
7.1518963e-001
-4.3563371e-003
7.1602565e-001
4.9811017e-003
7.1690754e-001
-5.6531875e-003
7.1783412e-001
-6.3726445e-003
7.1880409e-001
-7.1393708e-003
7.1981624e-001
-7.9535675e-003
7.2086900e-001
-8.8143242e-003
7.2196066e-001
-9.7217924e-003
7.2309313e-001
-1.0680008e-002
7.2426203e-001
1.1685914e-002
7.2546339e-001
-1.2736314e-002
7.2669501e-001
-1.3830276e-002
7.2795467e-001
-1.4966798e-002
7.2924011e-001
-1.6144824e-002
7.3054912e-001
-1.7363258e-002
7.3187947e-001
-1.8620971e-002
7.3323273e-001
-1.9924457e-002
7.3460202e-001
-2.1264789e-002
7.3598525e-001
-2.2640532e-002
7.3738037e-001
-2.4050454e-002

7.3875571e-001
-2.5494641e-002
7.4007517e-001
2.6973826e-002
7.4140335e-001
-2.8485589e-002
7.4274086e-001
-3.0032497e-002
7.4408531e-001
-3.1607288e-002
7.4543628e-001
3.3208664e-002
7.4679337e-001
-3.4835331e-002
7.4815624e-001
-3.6486025e-002
7.4952455e-001
3.8159511e-002
7.5089919e-001
-3.9858781e-002
7.5227873e-001
-4.1578605e-002
7.5366267e-001
-4.3316862e-002
7.5510936e-001
-4.5146809e-002
7.5651039e-001
-4.7058478e-002
7.5812447e-001
-4.8986028e-002
7.5962075e-001
-5.0927191e-002
7.6112844e-001
-5.2879869e-002
7.6263719e-001
-5.4843321e-002
7.6414583e-001
-5.6813710e-002
7.6565377e-001
-5.8789211e-002
7.6716049e-001
-6.0768127e-002
7.6866553e-001
-6.2748894e-002
7.7016850e-001
-6.4730089e-002
7.7164593e-001
-6.6707883e-002
7.7303507e-001
-6.8673177e-002
7.7442595e-001
-7.0636122e-002
7.7581473e-001
-7.2595735e-002
7.7720862e-001
-7.4551204e-002
7.7860713e-001
-7.6502101e-002
7.8001171e-001
-7.8448107e-002
7.8142371e-001
-8.0389006e-002
7.8284441e-001
-8.2324674e-002
7.8427501e-001
-8.4255077e-002
7.8571921e-001
-8.6180299e-002

7.8717657e-001
8.8100489e-002
7.8864724e 001
-9.0015763e-002
7.9023187e-001
-9.1926478e-002
7.9163103e-001
8.3832919e-002
7.9314516e-001
-9.5735434e-002
7.9467515e-001
-9.7634067e-002
7.9622429e-001
-9.9529773e-002
7.9778911e 001
-1.0142898e 001
7.9936958e-001
-1.0331415e-001
8.0096326e-001
-1.0520376e-001
8.0257612e 001
-1.0709230e 001
8.0420257e 001
-1.0898040e 001
8.0584651e-001
-1.1085912e-001
8.0749802e-001
-1.1277661e-001
8.0916040e-001
-1.1469077e-001
8.1083513e-001
-1.1660597e-001
8.1252136e-001
-1.1852235e 001
8.1421890e 001
-1.2044024e 001
8.1592733e-001
-1.2236000e 001
8.1764328e-001
-1.2428119e-001
8.1936543e-001
-1.2620380e-001
8.2113542e-001
-1.2817562e-001
8.2291452e-001
-1.3015501e-001
8.2489552e-001
-1.3213575e-001
8.2647614e-001
-1.3411793e 001
8.2825416e 001
-1.3610103e-001
8.3002783e-001
-1.3808491e-001
8.3179543e-001
-1.4006943e-001
8.3355527e-001
-1.4205444e-001
8.3530572e-001
-1.4403983e-001
8.3704306e-001
-1.4602544e-001
8.3876608e-001
-1.4801102e-001
8.4047416e-001
-1.4999638e-001
8.4216596e-001
-1.5198139e-001

8.4384022e-001
-1.5396590e-001
8.4549589e-001
-1.5594988e-001
8.4713004e-001
-1.5793295e-001
8.4857830e-001
-1.5990909e-001
8.4999524e-001
-1.6188369e-001
8.5139414e-001
-1.6385709e-001
8.5277699e-001
-1.6582932e-001
8.5414592e-001
-1.6780041e-001
8.5550294e-001
-1.6977013e-001
8.5684938e-001
-1.7173811e-001
8.5818668e-001
-1.7370433e-001
8.5952409e-001
-1.7566906e-001
8.6085799e-001
-1.7763239e-001
8.6219249e-001
-1.7959403e-001
8.6352981e-001
-1.8155389e-001
8.6487210e-001
-1.8351192e-001
8.6622326e-001
-1.8546784e-001
8.6758488e-001
-1.8742178e-001
8.6895842e-001
-1.8937366e-001
8.7034554e-001
-1.9132341e-001
8.7174792e-001
-1.9327110e-001
8.7316700e-001
-1.9521673e-001
8.7460428e-001
-1.9715988e-001
8.7606431e-001
1.9909990e-001
8.7754460e-001
-2.0103739e-001
8.7904580e-001
-2.0297231e-001
8.8058552e-001
2.0491776e-001
8.8216783e-001
-2.0687604e-001
8.8377157e-001
-2.0883051e-001
8.8539645e-001
-2.1078046e-001
8.8704377e-001
-2.1272421e-001
8.8870888e-001
2.1466218e-001
8.9039019e-001
-2.1659371e-001
8.9208597e-001
-2.1851820e-001

PAC \2106x\BLD1 1\CTAB.DAT 11/

8.9379445e-001
-2.2042527e-001
8.9551371e-001
-2.2234449e-001
8.9724124e 001
-2.2424495e-001
8.9906929e-001
-2.2623552e-001
9.0096103e 001
-2.2828283e-001
9.0285342e-001
-2.3031751e-001
9.0474054e 001
-2.3233753e-001
9.0661988e-001
-2.3434347e-001
9.0848812e-001
2.3633507e-001
9.1034127e 001
-2.3831735e-001
9.1217447e-001
-2.4027024e-001
9.1398668e-001
-2.4221371e-001
9.1577535e-001
-2.4414191e-001
9.1753603e-001
-2.4605278e-001
9.1926505e-001
-2.4794563e-001
9.2076864e-001
-2.4980550e-001
9.2223567e-001
-2.5165028e-001
9.2367185e-001
-2.5347630e-001
9.2508238e-001
-2.5528808e-001
9.2647024e-001
-2.5708742e-001
9.2783592e-001
-2.5887282e-001
9.2917963e-001
-2.6064233e-001
9.3050715e-001
-2.6240139e-001
9.3182041e-001
-2.6415140e 001
9.3311629e-001
-2.6588498e-001
9.3440242e-001
-2.6760983e-001
9.3568111e-001
-2.6932729e-001
9.3694921e 001
-2.7103156e-001
9.3820952e-001
-2.7272502e-001
9.3946811e-001
-2.7441379e-001
9.4072242e 001
-2.7609305e-001
9.4197844e-001
-2.7775952e-001
9.4321789e-001
-2.7942024e-001
9.4446299e-001
-2.8107224e-001

9.4570587e-001
-2.8271252e-001
9.4694944e-001
-2.8434709e-001
9.4819160e-001
2.8597320e-001
9.4942555e-001
-2.8758161e-001
9.5066574e-001
-2.8918815e-001
9.5192152e-001
-2.9080672e-001
9.5317983e-001
-2.9242104e-001
9.5444091e-001
-2.9403051e-001
9.5569935e-001
-2.9562939e-001
9.5694309e-001
-2.9720459e-001
9.5818491e-001
2.9877134e-001
9.5942067e-001
-3.0032403e-001
9.6063921e-001
-3.0185167e-001
9.6185317e-001
-3.0336903e-001
9.6305413e-001
-3.0486605e-001
9.6423690e-001
-3.0633843e-001
9.6541365e-001
3.0779987e-001
9.6656864e-001
-3.0923285e-001
9.6770745e-001
-3.1064445e-001
9.6883668e-001
-3.1204301e-001
9.6993680e-001
3.1340528e-001
9.7102408e-001
3.1475159e-001
9.7209486e-001
3.1607783e-001
9.7313699e-001
-3.1736949e-001
9.7416519e-001
-3.1864488e-001
9.7517048e-001
-3.1989337e-001
9.7615082e-001
3.2111247e-001
9.7711241e-001
-3.2231032e-001
9.7801660e-001
-3.2343837e-001
9.7889765e-001
-3.2454037e-001
9.7976192e-001
-3.2562223e-001
9.8059030e-001
-3.2666368e-001
9.8140088e-001
-3.2768274e-001
9.8219080e-001
-3.2868065e-001

9.8294690e 001
3.2963708e-001
9.8368649e-001
-3.3057439e-001
9.8440280e-001
-3.3148699e 001
9.8509114e 001
3.3236394e-001
9.8576156e 001
-3.3322183e-001
9.8640762e-001
3.3405163e-001
9.8703092e 001
-3.3485220e-001
9.8763684e-001
-3.3563451e-001
9.8821332e-001
-3.3638424e-001
9.8877683e-001
-3.3711198e-001
9.8930453e-001
-3.3782318e-001
9.8976164e-001
-3.3849537e-001
9.9020916e-001
-3.3915347e-001
9.9064233e-001
-3.3979048e-001
9.9105212e-001
-3.4039768e-001
9.9145156e-001
-3.4099109e-001
9.9183263e-001
-3.4155719e-001
9.9220172e-001
-3.4210549e-001
9.9255764e-001
-3.4263715e-001
9.9289280e-001
-3.4313915e-001
9.9322072e-001
-3.4363030e-001
9.9353421e-001
-3.4409984e-001
9.9383550e-001
-3.4455111e-001
9.9412636e-001
3.4498905e 001
9.9439885e-001
-3.4539964e-001
9.9466541e-001
-3.4580120e-001
9.9491970e-001
3.4618447e-001
9.9516325e-001
-3.4655145e-001
9.9540055e-001
-3.4690902e-001
9.9562003e-001
-3.4724091e-001
9.9583468e 001
3.4756552e-001
9.9603786e-001
3.4787283e-001
9.9623391e-001
-3.4816777e-001
9.9642141e-001
-3.4845285e-001

```
 9.9659836e-001
-3.4872000e-001
 9.9677085e-001
-3.4898131e-001
 9.9693198e-001
-3.4922500e-001
 9.9708673e-001
-3.4945931e-001
 9.9723403e-001
-3.4968232e-001
 9.9737344e-001
-3.4989339e-001
 9.9750893e-001
-3.5009853e-001
 9.9763412e-001
-3.5028807e-001
 9.9775665e-001
-3.5047358e-001
 9.9787053e-001
 3.5064601e-001
 9.9798034e-001
-3.5081226e-001
 9.9808441e-001
-3.5096982e-001
 9.9818253e-001
-3.5111838e-001
 9.9827741e-001
-3.5126204e-001
 9.9836484e-001
-3.5139441e-001
 9.9845032e-001
-3.5152378e-001
 9.9852820e-001
-3.5164153e-001
 9.9860390e-001
-3.5175597e-001
 9.9867449e-001
-3.5186270e-001
 9.9874172e-001
-3.5196433e-001
 9.9880561e-001
-3.5206092e-001
 9.9886520e-001
-3.5215102e-001
 9.9892295e-001
-3.5223832e-001
 9.9897572e-001
-3.5231812e-001
 9.9902752e-001
-3.5239642e-001
 9.9907460e-001
-3.5246760e-001
 9.9912658e-001
-3.5254633e-001
 9.9919425e-001
-3.5264834e-001
 9.9925942e-001
-3.5274701e-001
 9.9932238e-001
-3.5284220e-001
 9.9938234e-001
-3.5293286e-001
 9.9944116e-001
-3.5302178e-001
 9.9949637e-001
-3.5310525e-001
 9.9955079e-001
 3.5318752e-001
```

```
 9.9960237e-001
-3.5326550e-001
 9.9965271e-001
-3.5334162e-001
 9.9970117e-001
-3.5341487e-001
 9.9974791e-001
-3.5348554e-001
 9.9979354e-001
-3.5355452e 001
 9.9983712e-001
-3.5362040e-001
 9.9988220e-001
-3.5368554e-001
 9.9992103e-001
-3.5374728e-001
 9.9996133e-001
-3.5380798e-001
 1.0000000e+000
 3.5386621e-001
```

AUL\2106X\BLD1 J\RTAB.DAT 1/1

```
 7.0710678e-001
 0.0000000e-000
 7.0710678e-001
 0.0000000e-000
 7.0710678e-001
 0.0000000e+000
 7.0710678e-001
 0.0000000e+000
 7.0710678e-001
 0.0000000e+000
 7.0710678e 001
 0.0000000e+000
 7.0710678e-001
 0.0000000e+000
 7.0710678e-001
 0.0000000e-000
 7.0710678e 001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e-001
 0.0000000e+000
 7.0710678e 001
 0.0000000e+000
 7.0710678e-001
 0.0000000e+000
 7.0710678e 001
 0.0000000e+000
 7.0710678e 001
 0.0000000e+000
 7.0710678e-001
 0.0000000e+000
 7.0710746e-001
 0.0000000e-000
 7.0711723e-001
 0.0000000e+000
 7.0714203e-001
 0.0000000e+000
 7.0718363e-001
 0.0000000e+000
 7.0724405e 001
-1.6926500e 006
 7.0732500e-001
-1.2074841e-005
 7.0742824e-001
-4.3594117e-005
 7.0755565e-001
 9.7456406e-005
 7.0771216e 001
-1.7648209e-004
 7.0789529e-001
-2.8225003e-004
 7.0810700e-001
-4.1708235e-004
 7.0834865e 001
 5.8558064e 004
 7.0862152e-001
-7.8437396e 004
 7.0892606e-001
 1.0215818e 003
 7.0926381e 001
 1.2982010e 003
 7.0963458e 001
-1.6150340e-003
```

:\PAUL\2106X\BLD2_1\RTAB.DAT 1 /95

7.1003942e-001
-1.9775719e-003
7.1047843e-001
-2.3851310e-003
7.1094282e-001
2.8416535e-003
7.1141228e-001
-3.3537061e-003
7.1191653e 001
-3.9175170e-003
7.1245610e-001
-4.5348721e-003
7.1303123e-001
5.2073038e-003
7.1364300e-001
-5.9381162e-003
7.1429008e-001
-6.7265464e-003
7.1497126e-001
7.5724148e-003
7.1568588e-001
-8.4763360e 003
7.1643317e 001
-9.4387911e-003
7.1721166e-001
-1.0459417e-002
7.1802032e-001
-1.1538413e-002
7.1885747e-001
-1.2675142e-002
7.1972154e-001
-1.3869086e-002
7.2061081e-001
1.5119490e-002
7.2152336e-001
1.6425345e-002
7.2245726e 001
-1.7785533e 002
7.2341041e 001
-1.9198630e-002
7.2438093e-001
2.0663502e-002
7.2536631e-001
2.2177947e-002
7.2636478e 001
-2.3740753e-002
7.2736099e-001
-2.5351001e-002
7.2831142e-001
-2.7009318e-002
7.2927058e-001
2.8721142e-002
7.3023723e 001
-3.045332Be-002
7.3121080e-001
-3.2333881e-002
7.3219138e-001
-3.4052932e-002
7.3317684e 001
3.5903997e-002
7.3417214e-001
-3.7793272e 002
7.3517450e 001
-3.9720056e 002
7.3618086e-001
-4.1677472e-002
7.3719069e-001
4.3646951e-002

```
 7.3820312e-001
-4.5643366e-002
 7.3921688e-001
-4.7655721e-002
 7.4023259e-001
-4.9686776e-002
 7.4124929e-001
-5.1730275e-002
 7.4226597e-001
-5.3783737e-002
 7.4328334e-001
-5.5847313e-002
 7.4430047e-001
 5.7917820e-002
 7.4531651e-001
-5.9992302e-002
 7.4633234e-001
-6.2072364e-002
 7.4734707e-001
 6.4152093e-002
 7.4836003e-001
-6.6232071e-002
 7.4930064e-001
-6.8299227e-002
 7.5023927e-001
-7.0363994e-002
 7.5117864e-001
-7.2424677e-002
 7.5212115e-001
-7.4483166e-002
 7.5306748e-001
-7.6537811e-002
 7.5401800e-001
-7.8586516e-002
 7.5497507e-001
-8.0631736e-002
 7.5593930e-001
-8.2672465e-002
 7.5691355e-001
-8.4706348e-002
 7.5789205e-001
-8.6736388e-002
 7.5888137e-001
-8.8762254e-002
 7.5988176e-001
-9.0781175e-002
 7.6089400e-001
-9.2796697e-002
 7.6191783e-001
 9.4809000e-002
 7.6295183e-001
-9.6815158e-002
 7.6399771e-001
-9.8818662e-002
 7.6505552e-001
-1.0081997e-001
 7.6612384e-001
-1.0281701e-001
 7.6720343e-001
-1.0481209e-001
 7.6829447e-001
-1.0680671e-001
 7.6939733e-001
-1.0879864e-001
 7.7051008e-001
-1.1079011e-001
 7.7162891e-001
 1.1280075e-001
```

7.7275516e-001
-1.1481829e-001
7.7388924e-001
-1.1683506e-001
7.7503117e-001
-1.1885255e-001
7.7617992e-001
-1.2087049e-001
7.7733371e-001
-1.2288743e-001
7.7849334e-001
-1.2490556e-001
7.7965650e-001
-1.2692427e-001
7.8082137e-001
-1.2894242e-001
7.8198737e-001
-1.3096092e-001
7.8315346e-001
-1.3297993e-001
7.8431822e-001
1.3499895e-001
7.8548059e-001
-1.3701810e-001
7.8663917e-001
-1.3903781e-001
7.8779235e-001
-1.4105780e-001
7.8893930e-001
-1.4307789e-001
7.9007912e-001
-1.4509833e-001
7.9121072e-001
-1.4711897e-001
7.9233327e-001
-1.4914000e-001
7.9344593e-001
-1.5116157e-001
7.9454645e-001
1.5318332e-001
7.9563369e-001
-1.5520509e-001
7.9677973e-001
-1.5736215e-001
7.9783014e-001
-1.5951819e-001
7.9887583e-001
-1.6167196e-001
7.9980762e-001
1.6382540e-001
8.0077758e-001
-1.6597914e-001
8.0173711e-001
-1.6813209e-001
8.0268811e-001
1.7028404e-001
8.0363257e-001
-1.7243479e-001
8.0457276e-001
-1.7458469e-001
8.0551056e-001
-1.7673519e-001
8.0644796e-001
-1.7887990e-001
8.0738721e-001
-1.8102453e-001
8.0833051e-001
1.8316720e-001

8.0927982e-001
-1.8530799e-001
8.1023675e 001
-1.8744638e-001
8.1120299e-001
-1.8958223e-001
8.1218009e-001
-1.9171545e-001
8.1316958e-001
-1.9384617e-001
8.1417257e 001
-1.9597402e-001
8.1519009e-001
1.9809878e-001
8.1622303e 001
-2.0022034e-001
8.1727208e-001
-2.0233850e-001
8.1834325e-001
-2.0446009e-001
8.1945302e-001
-2.0660357e-001
8.2057970e 001
-2.0874246e-001
8.2172264e 001
-2.1087601e-001
8.2288149e 001
-2.1300325e-001
8.2405488e-001
-2.1512351e-001
8.2524105e-001
-2.1723622e-001
8.2643850e-001
-2.1934077e-001
8.2764559e 001
-2.2143661e-001
8.2886055e-001
2.2352328e-001
8.3008148e-001
-2.2560033e-001
8.3130644e-001
-2.2766742e-001
8.3253341e-001
-2.2972430e 001
8.3376035e 001
-2.3177080e 001
8.3498521e-001
-2.3380683e-001
8.3620592e-001
-2.3583234e-001
8.3742052e-001
-2.3784748e-001
8.3862706e 001
-2.3985244e-001
8.3983367e-001
-2.4184748e-001
8.4100858e-001
2.4383299e 001
8.4217935e 001
-2.4580895e 001
8.4333457e-001
-2.4777672e-001
8.4435565e 001
-2.4971935e-001
8.4534435e-001
-2.5165324e 001
8.4631867e 001
-2.5358148e-001

8.4728024e-001
-2.5550524e-001
8.4823083e-001
-2.5742604e-001
8.4917232e-001
-2.5934529e-001
8.5013002e-001
-2.6131266e-001
8.5109290e-001
-2.6330355e-001
8.5205242e-001
2.6529754e-001
8.5301067e-001
-2.6729606e-001
8.5396972e-001
-2.6930049e-001
8.5493156e-001
-2.7131218e-001
8.5589809e-001
-2.7333241e-001
8.5687100e-001
-2.7536223e-001
8.5785197e-001
-2.7740288e-001
8.5884249e-001
-2.7945541e-001
8.5984384e-001
-2.8152074e-001
8.6085714e-001
-2.8359969e-001
8.6188329e-001
-2.8569296e-001
8.6292301e-001
-2.8780111e-001
8.6397729e-001
-2.8992552e-001
8.6507346e-001
-2.9211643e-001
8.6618440e-001
-2.9432312e-001
8.6730906e-001
-2.9654420e-001
8.6844650e-001
-2.9877848e-001
8.6959549e-001
-3.0102452e-001
8.7075471e-001
-3.0328096e-001
8.7192274e-001
-3.0554643e-001
8.7308797e-001
-3.0781941e-001
8.7427868e-001
-3.1009832e-001
8.7546209e-001
-3.1238157e-001
8.7664937e-001
-3.1466756e-001
8.7783564e-001
-3.1695472e-001
8.7902005e-001
-3.1924149e-001
8.8020077e-001
-3.2152635e-001
8.8137600e-001
-3.2380786e-001
8.8254400e-001
3.2608460e-001

8.8370312e-001
-3.2835526e-001
8.8485179e-001
-3.3061858e-001
8.8598857e-001
-3.3287339e-001
8.8711169e-001
-3.3511834e-001
8.8821942e-001
-3.3734201e-001
8.8920355e-001
-3.3957171e-001
8.9015968e-001
-3.4177823e-001
8.9110216e-001
-3.4397112e-001
8.9203288e-001
-3.4614980e-001
8.9295354e-001
-3.4831379e-001
8.9386602e-001
-3.5046277e-001
8.9477420e-001
-3.5260104e-001
8.9573030e-001
-3.5484605e-001
8.9668404e-001
-3.5707356e-001
8.9763760e-001
-3.5928300e-001
8.9859314e-001
-3.6147392e-001
8.9955279e-001
3.6364606e-001
9.0051860e-001
3.6579928e-001
9.0149255e-001
-3.6793356e-001
9.0247650e-001
-3.7004912e-001
9.0347217e-001
3.7214614e-001
9.0448117e-001
-3.7422501e-001
9.0550492e-001
-3.7628620e-001
9.0654467e-001
-3.7833023e-001
9.0760153e-001
-3.8035770e-001
9.0867785e-001
3.8237688e-001
9.0977662e-001
-3.8439668e-001
9.1089547e-001
-3.8640094e-001
9.1203463e-001
3.8839007e-001
9.1319409e-001
3.9036457e-001
9.1437362e-001
-3.9232500e-001
9.1557279e-001
-3.9427195e-001
9.1679093e-001
3.9620604e-001
9.1802722e-001
-3.9812799e-001

9.1928069e-001
-4.0003853e-001
9.2055020e-001
-4.0193839e-001
9.2183449e-001
-4.0382832e-001
9.2313218e-001
-4.0570904e-001
9.2444182e-001
-4.0758130e-001
9.2576190e-001
-4.0944587e-001
9.2709095e-001
-4.1130356e-001
9.2842729e-001
-4.1315499e-001
9.2976933e-001
-4.1500083e-001
9.3111544e-001
4.1684169e-001
9.3246403e-001
-4.1867818e-001
9.3380591e-001
-4.2051286e-001
9.3507252e-001
-4.2236423e-001
9.3636702e-001
-4.2425329e-001
9.3773110e-001
-4.2623986e-001
9.3909490e-001
-4.2822122e-001
9.4045852e-001
-4.3019658e-001
9.4182122e-001
-4.3216383e-001
9.4318267e-001
-4.3412136e-001
9.4454277e-001
-4.3606786e-001
9.4590120e-001
-4.3800166e-001
9.4725760e-001
-4.3992107e-001
9.4861178e-001
-4.4182464e-001
9.4996332e-001
-4.4370985e-001
9.5131202e-001
-4.4557582e-001
9.5265759e-001
-4.4742151e-001
9.5399968e-001
-4.4924559e-001
9.5533801e-001
-4.5104699e-001
9.5667206e-001
-4.5282440e-001
9.5800164e-001
-4.5457681e-001
9.5928793e-001
-4.5629760e-001
9.6056909e-001
-4.5798640e-001
9.6183588e-001
-4.5964681e-001
9.6309895e-001
4.6127850e-001

9.6435849e-001
-4.6288028e-001
9.6561510e-001
-4.6445115e 001
9.6686903e-001
-4.6599270e-001
9.6812025e-001
-4.6750474e-001
9.6936884e-001
-4.6898751e-001
9.7061447e-001
-4.7044102e-001
9.7185681e-001
-4.7186548e-001
9.7309532e-001
4.7326104e-001
9.7452937e-001
-4.7462796e-001
9.7562377e-001
-4.7603758e-001
9.7698025e-001
4.7745771e-001
9.7826531e-001
4.7884035e-001
9.7956633e-001
-4.8018616e-001
9.8085051e-001
-4.8149499e 001
9.8209649e 001
-4.8277660e 001
9.8350111e 001
-4.8402748e 001
9.8447971e 001
4.8523525e-001
9.8562679e-001
4.8639362e-001
9.8674198e-001
4.8750480e-001
9.8762398e-001
4.8856898e-001
9.8887036e-001
-4.8985801e-001
9.8987946e-001
-4.9055251e-001
9.9084964e 001
-4.9147121e-001
9.9177638e-001
-4.9233757e-001
9.9265928e-001
4.9315295e-001
9.9349874e-001
4.9391954e-001
9.9429343e-001
-4.9463744e 001
9.9504271e-001
4.9530731e-001
9.9574569e-001
-4.9592962e-001
9.9640163e 001
-4.9650490e 001
9.9701015e-001
-4.9703395e 001
9.9757027e 001
-4.9751717e-001
9.9795597e 001
-4.9789273e 001
9.9830200e 001
4.9823148e-001

PAUL\2:06X\BLD1_1\RTAB.DAT 11.

```
 9.9862684e-001
 4.9855127e-001
 9.9890239e-001
-4.9882354e-001
 9.9913028e 001
-4.9904932e-001
 9.9931449e-001
-4.9923141e-001
 9.9946441e-001
-4.9937827e-001
 9.9956401e-001
-4.9949390e 001
 9.9967947e-001
-4.9958126e-001
 9.9975245e-001
-4.9964363e-001
 9.9981033e 001
-4.9968746e-001
 9.9985678e-001
 4.9971615e-001
 9.9989508e-001
 4.9973294e-001
 9.9992812e-001
-4.9974059e-001
 9.9995825e-001
-4.9974120e 001
 9.9998788e 001
-4.9973786e 001
 1.0000000e+000
-4.9972615e-001
 1.0000000e+000
-4.9970275e-001
 1.0000000e+000
-4.9968074e-001
 1.0000000e+000
-4.9966154e-001
 1.0000000e-000
 4.9964631e-001
 1.0000000e+000
-4.9963552e-001
 1.0000000e+000
-4.9963111e-001
 1.0000000e+000
-4.9963394e-001
 1.0000000e+000
-4.9964396e-001
 1.0000000e+000
-4.9966072e-001
 1.0000000e+000
-4.9968354e-001
 1.0000000e+000
-4.9971147e-001
 1.0000000e+000
-4.9974352e-001
 1.0000000e+000
 4.9977854e-001
 1.0000000e-000
 4.9981552e-001
 1.0000000e+000
-4.9985344e-001
 1.0000000e+000
-4.9989145e-001
 1.0000000e+000
-4.9992887e 001
 1.0000000e+000
-4.9996516e 001
 1.0000000e-000
 5.0000000e-001
```

PAUL\2106X\H001_1\RTAB.DAT 11. 5

```
 1.0000000e+000
-5.0000000e-001
 1.0000000e+000
-5.0000000e-001
 1.0000000e+000
 5.0000000e-001
 1.0000000e+000
-5.0000000e-001
 1.0000000e+000
-5.0000000e-001
 1.0000000e+000
-5.0000000e-001
 1.0000000e+000
-5.0000000e-001
 1.0000000e+000
-5.0000000e-001
 1.0000000e+000
-5.0000000e-001
 1.0000000e+000
-5.0000000e-001
```

PAUL\2106X\BLD1_1\STAB2.DAT 11 35

```
0.0000000e+000
0.0000000e+000
0.0000000e+000
0.0000000e+000
0.0000000e-000
0.0000000e-000
0.0000000e+000
0.0000000e+000
0.0000000e+000
0.0000000e+000
0.0000000e+000
0.0000000e+000
0.0000000e+000
0.0000000e+000
0.0000000e+000
0.0000000e-000
0.0000000e-000
0.0000000e-000
0.0000000e+000
0.0000000e+000
0.0000000e+000
0.0000000e+000
0.0000000e+000
0.0000000e+000
0.0000000e+000
0.0000000e+000
0.0000000e+000
0.0000000e-000
0.0000000e-000
0.0000000e+000
0.0000000e+000
0.0000000e+000
0.0000000e+000
0.0000000e+000
0.0000000e+000
0.0000000e+000
0.0000000e+000
0.0000000e+000
0.0000000e+000
0.0000000e+000
0.0000000e-000
0.0000000e-000
0.0000000e+000
0.0000000e+000
0.0000000e+000
0.0000000e+000
0.0000000e+000
0.0000000e+000
0.0000000e+000
0.0000000e+000
0.0000000e+000
0.0000000e+000
0.0000000e+
```

PAGE \2106M\8101_1\STAB2.DAT 11 95

```
 0.0000000e-000
 0.0000000e-000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e-000
 0.0000000e-000
 0.0000000e-000
 0.0000000e-000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e-000
 0.0000000e-000
 0.0000000e-000
 0.0000000e-000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
 0.0000000e+000
-1.0828955e-005
-5.9889685e-005
-1.4866655e-004
-2.8337834e-004
-4.7348837e-004
-7.3034890e-004
-1.0540932e-003
 1.4509182e-003
-1.9388753e-003
-2.5166766e-003
-3.1971111e-003
-3.9797909e-003
-4.8779839e-003
-5.8826915e-003
-7.0214904e-003
-8.2598519e-003
-9.6219264e-003
 1.1118095e-002
```

-1.2732182e-002
1.4462603e-002
-1.6325299e-002
-1.8297657e-002
-2.0386179e-002
-2.2590177e-002
-2.4893155e-002
-2.7312443e-002
-2.9825759e-002
-3.2427369e-002
-3.5118812e-002
-3.7881043e-002
4.0717047e-002
4.3613635e-002
4.6562935e-002
-4.9563321e-002
-5.2600813e-002
-5.5673685e-002
-5.8773637e-002
-6.1894258e-002
-6.5033029e-002
6.8375841e-002
7.1745618e-002
-7.5118860e-002
-7.8493115e-002
-8.1865484e-002
-8.5234601e-002
-8.8599312e-002
-9.1958573e-002
-9.5312433e-002
-9.8662308e-002
-1.0200845e-001
-1.0535278e-001
-1.0869563e-001
-1.1204800e-001
-1.1543308e-001
-1.1881832e-001
-1.2220264e-001
-1.2558477e-001
-1.2896403e-001
-1.3233723e-001
-1.3570307e-001
-1.3906147e-001
-1.4241175e-001
-1.4575240e-001
-1.4908113e-001
-1.5239547e-001
-1.5569720e-001
-1.5898187e-001
1.6224514e-001
1.6549092e-001
-1.6872053e-001
-1.7193565e-001
-1.7513483e-001
-1.7831821e-001
-1.8148468e-001
-1.8463624e-001
-1.8777401e-001
-1.9089626e-001
-1.9400290e-001
-1.9709683e-001
-2.0017681e-001
-2.0324343e-001
-2.0633170e-001
-2.0941713e-001
-2.1248799e-001
-2.1554146e-001
2.1857548e-001

PAUL\2106X\DID1_1\STAB2.DAT 11 5

-2.2159162e-001
-2.2458728e-001
-2.2756142e-001
-2.3049895e-001
-2.3338259e 001
-2.3625426e-001
-2.3910984e-001
-2.4194821e-001
-2.4477034e-001
-2.4758059e-001
-2.5035904e-001
-2.5312492e-001
-2.5588763e 001
-2.5865262e-001
-2.6142545e-001
-2.6420866e-001
-2.6700803e-001
-2.6983238e 001
-2.7268238e-001
2.7556529e-001
2.7848379e-001
-2.8144677e-001
2.8445474e-001
-2.8750667e-001
-2.9063729e-001
-2.9387694e-001
-2.9716823e-001
-3.0051605e-001
-3.0391205e-001
-3.0735216e-001
-3.1083282e-001
-3.1435256e-001
-3.1789849e-001
3.2146830e-001
-3.2506230e-001
-3.2866398e-001
-3.3227052e-001
-3.3588390e-001
-3.3948571e-001
-3.4307107e-001
3.4664829e-001
3.5018733e-001
3.5372354e-001
3.5722405e-001
-3.6069375e-001
-3.6412985e-001
-3.6754083e-001
-3.7091601e 001
-3.7426202e-001
-3.7758454e 001
-3.8087218e-001
-3.8417085e-001
3.8745457e-001
-3.9070946e-001
-3.9395075e-001
-3.9716699e-001
-4.0036220e-001
-4.0354697e-001
4.0671100e-001
4.0986276e-001
-4.1300474e-001
4.1617361e-001
4.1962636e-001
-4.2309438e-001
-4.2654908e-001
4.2998133e-001
4.3338144e-001
-4.3674439e 001

-4.4006522e-001
-4.4333503e-001
-4.4654996e-001
-4.4970272e-001
4.5278903e-001
-4.5580002e-001
-4.5871521e-001
-4.6154686e-001
-4.6428816e-001
-4.6693604e-001
-4.6949457e-001
-4.7195410e-001
-4.7432225e-001
-4.7659579e-001
-4.7877031e-001
-4.8084774e-001
-4.8283336e-001
-4.8473633e-001
-4.8653217e-001
4.8823932e-001
-4.8977087e-001
-4.9121120e-001
-4.9253429e-001
-4.9374548e-001
-4.9482797e-001
-4.9580017e-001
-4.9666240e-001
-4.9740964e-001
-4.9798179e-001
-4.9843951e-001
-4.9880336e-001
-4.9908982e-001
-4.9930987e-001
-4.9947048e-001
4.9958708e-001
4.9966304e-001
-4.9971238e-001
4.9973789e-001
-4.9974940e-001
-4.9974971e-001
-4.9974457e-001
-4.9971869e-001
-4.9969070e-001
-4.9966693e-001
-4.9965040e-001
-4.9964141e-001
-4.9964068e-001
-4.9964993e-001
-4.9966718e-001
-4.9969226e-001
-4.9972385e-001
4.9976231e-001
-4.9980502e-001
-4.9985107e-001
-4.9989932e-001
-4.9994824e-001
-4.9999742e-001
-5.0000000e-001
5.0000000e-001
5.0000000e-001
-5.0000000e-001
-5.0000000e-001
5.0000000e-001
-5.0000000e-001
-5.0000000e-001
-5.0000000e-001
-5.0000000e-001
-5.0000000e-001

.PAUL\2106X\B1.01 F:\RTAB2.DAT 1. 95

```
-5.0000000e-001
-5.0000000e-001
-5.0000000e-001
-5.0000000e-001
-5.0000000e-001
-5.0000000e-001
 5.0000000e-001
-5.0000000e-001
 5.0000000e-001
-5.0000000e-001
```

APPENDIX B

PLAYER.BIN - Copyright SONY Corp. 19..
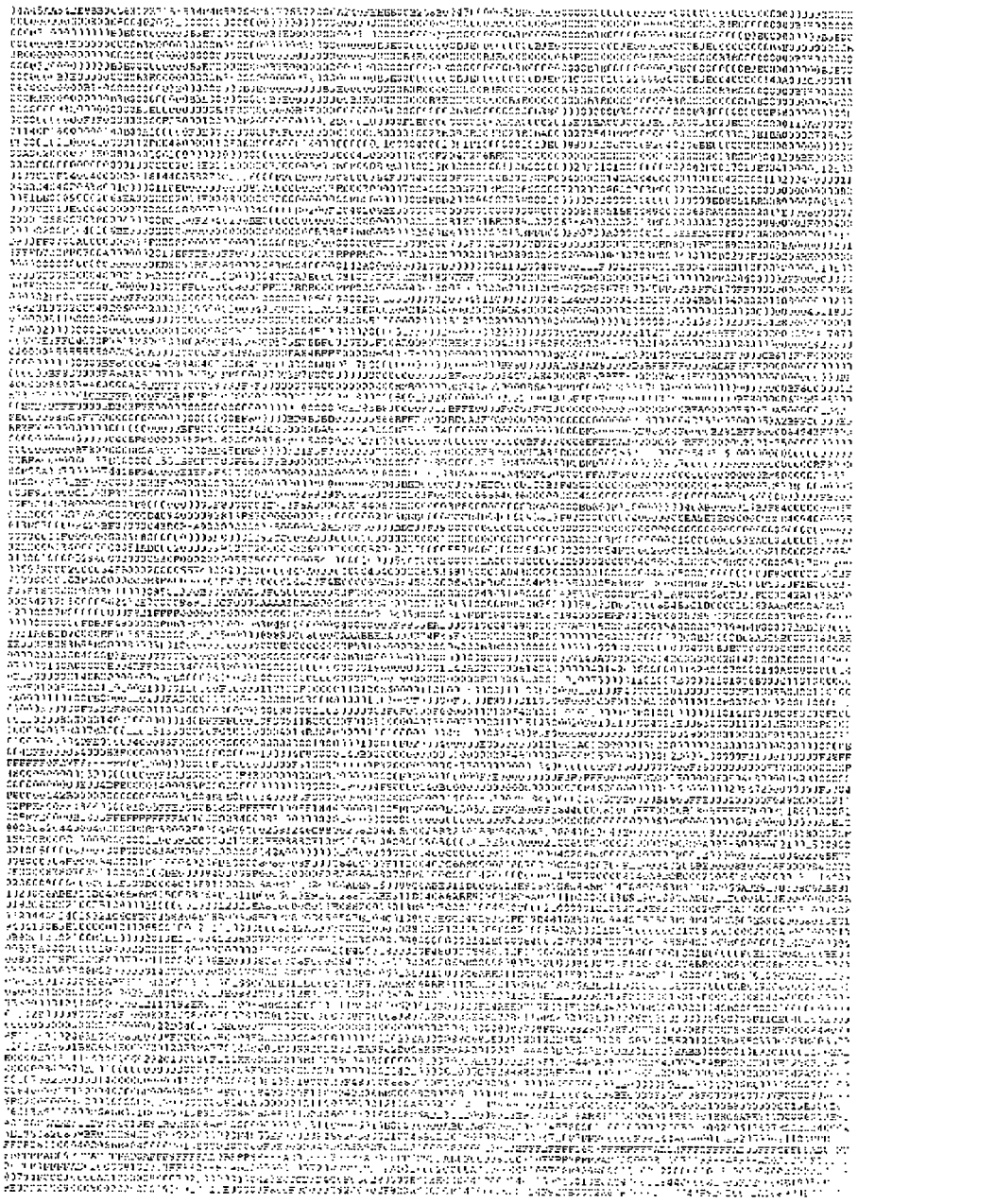

PLAYER BIN - Copyright SONY Corp. 1995
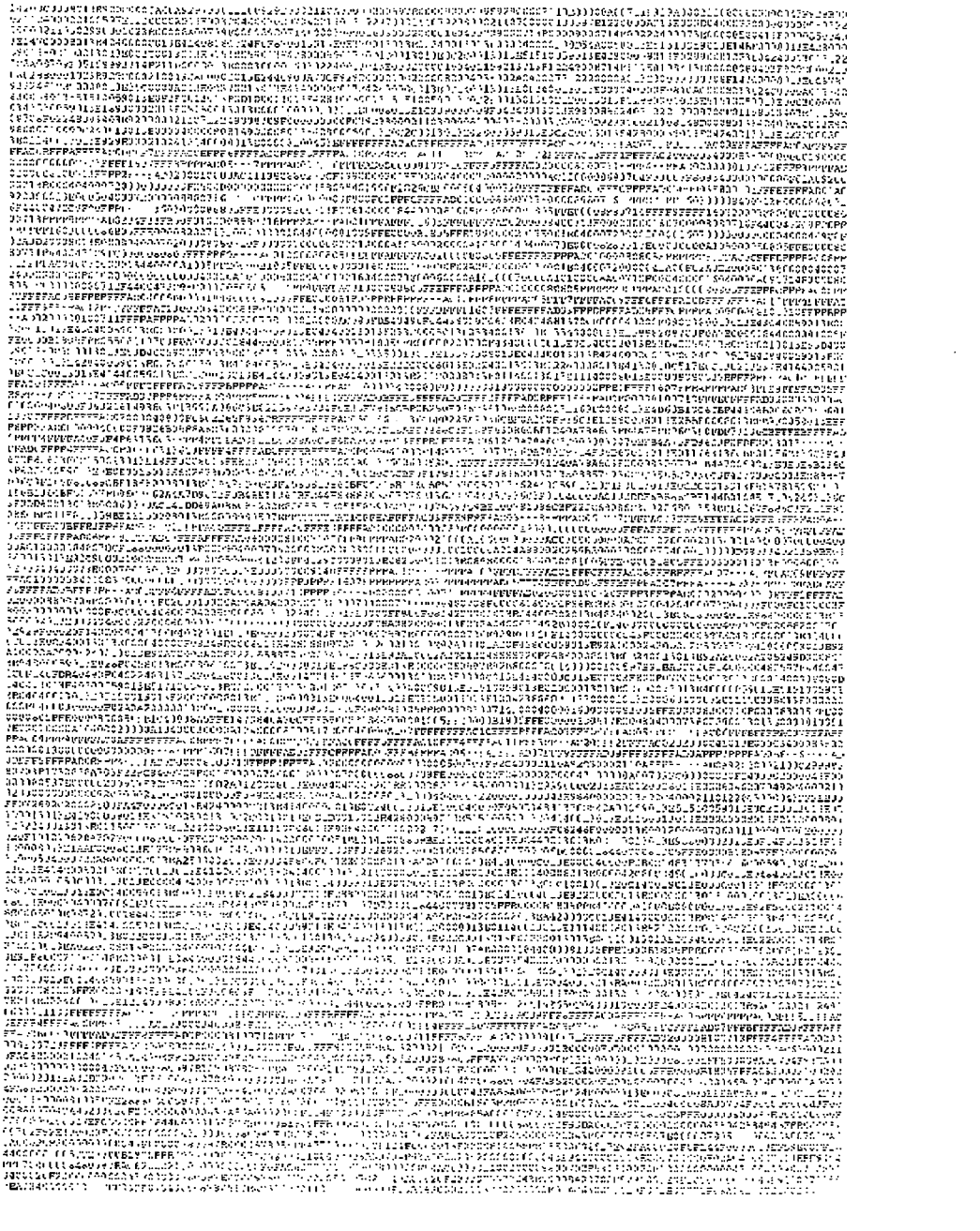

PLAYER BIN - Copyright SONY Corp. 1995
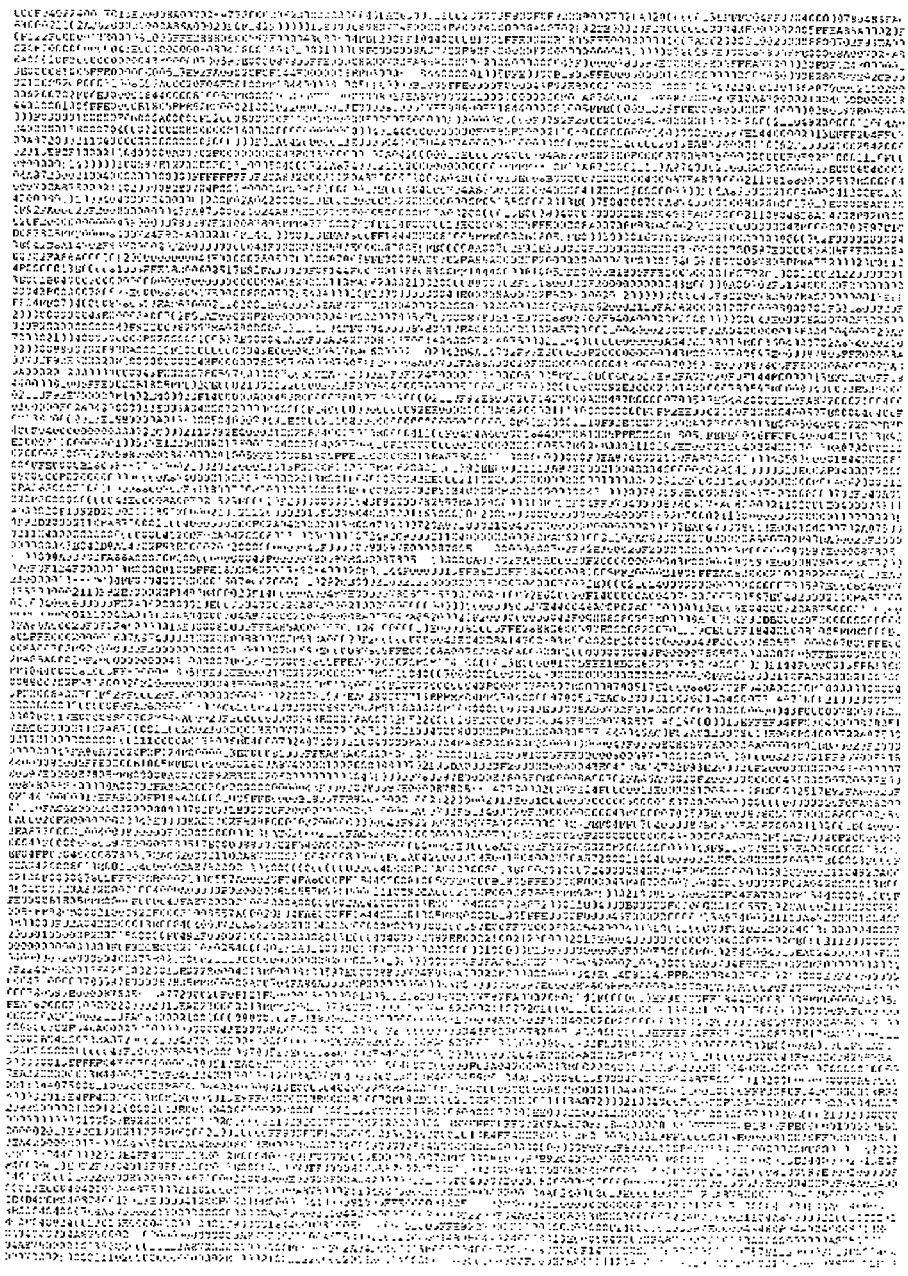

PLAYER.BIN - Copyright SONY Corp. 19..
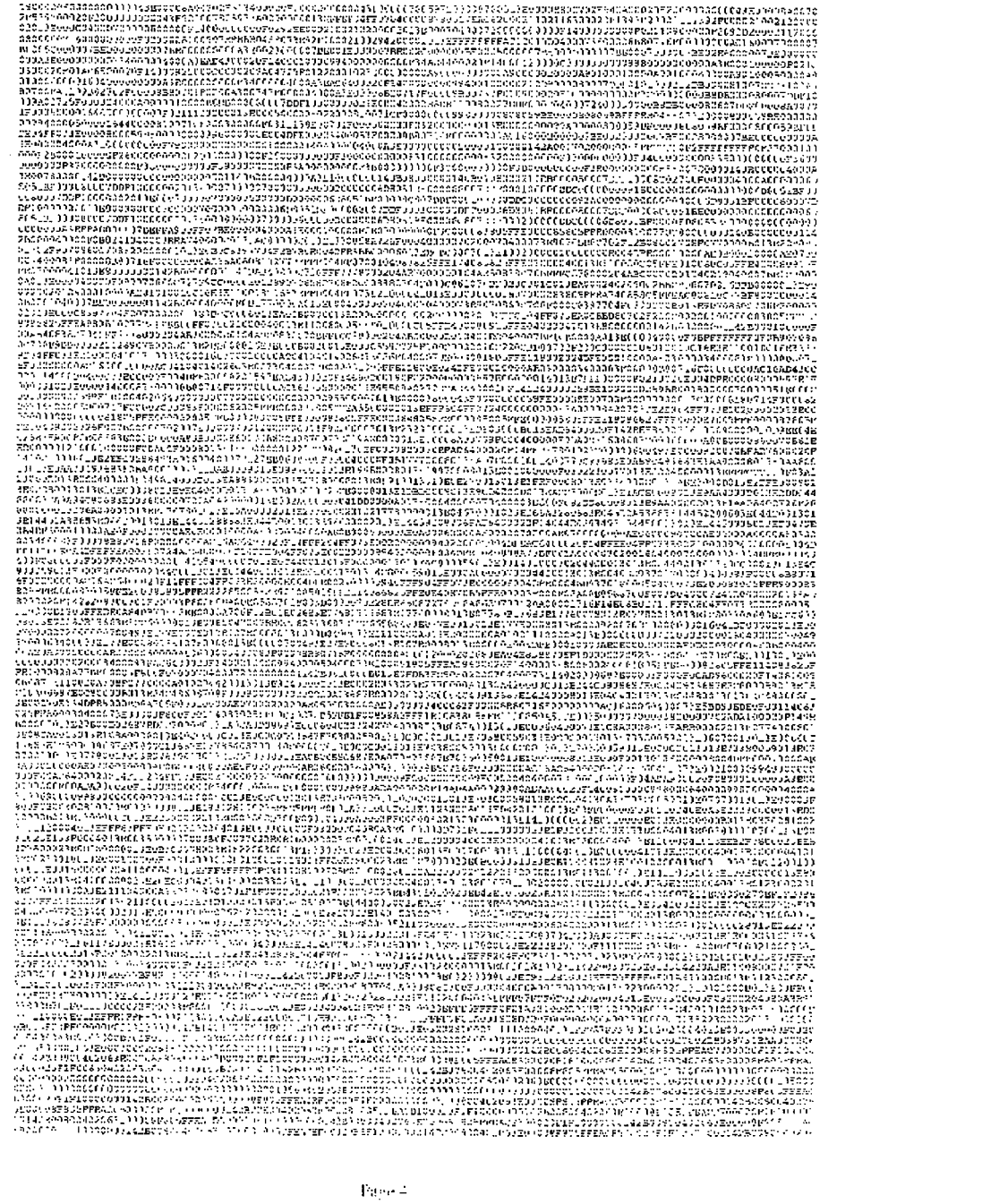

PLAYER.BIN - Copyright SONY Corp. 1...
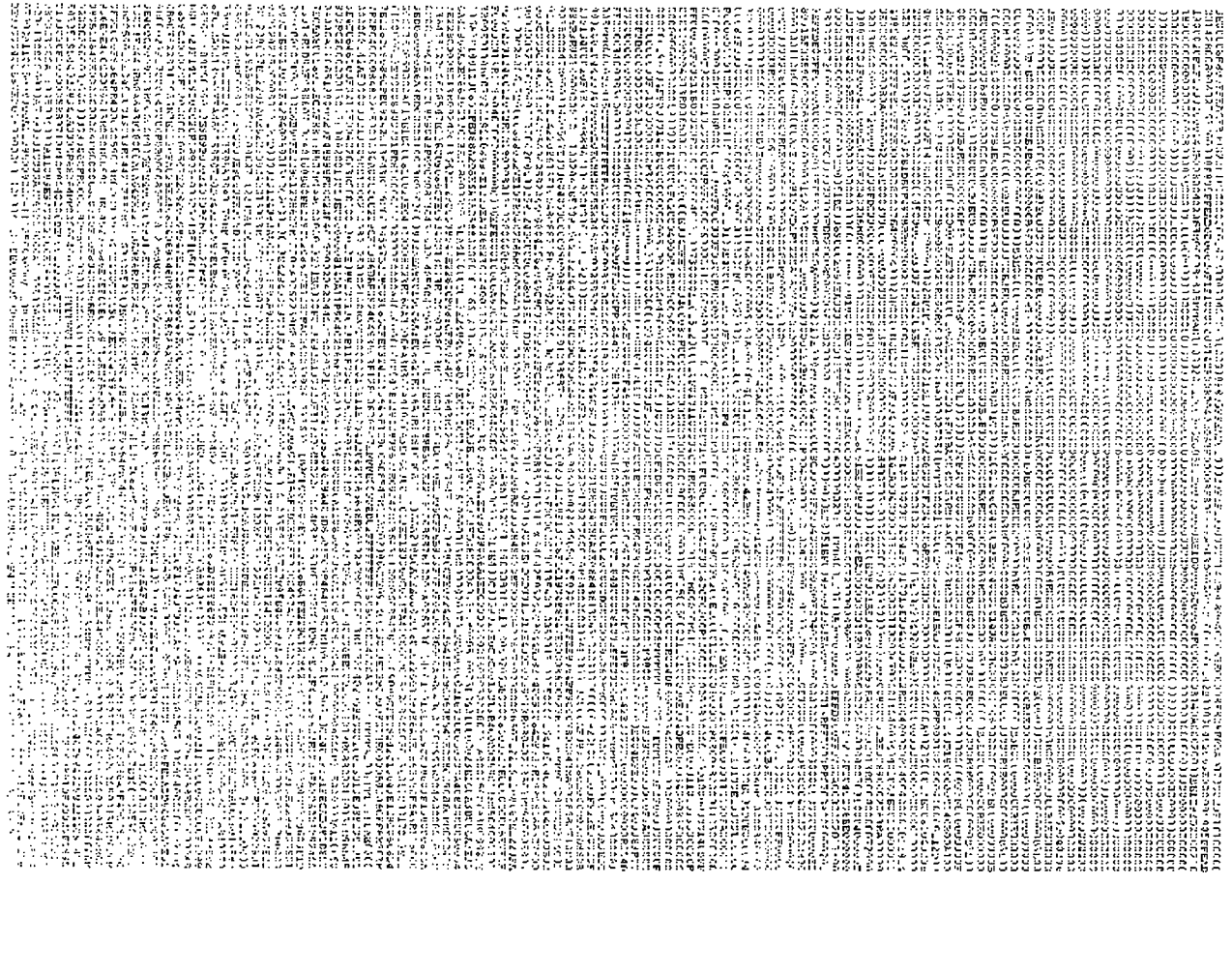

PLAYER.BIN - Copyright SONY Corp. 199[illegible]

PLAYER.BIN Copyright SONY Corp. 1992

PLAYER.BIN - Copyright SONY Corp. 1990
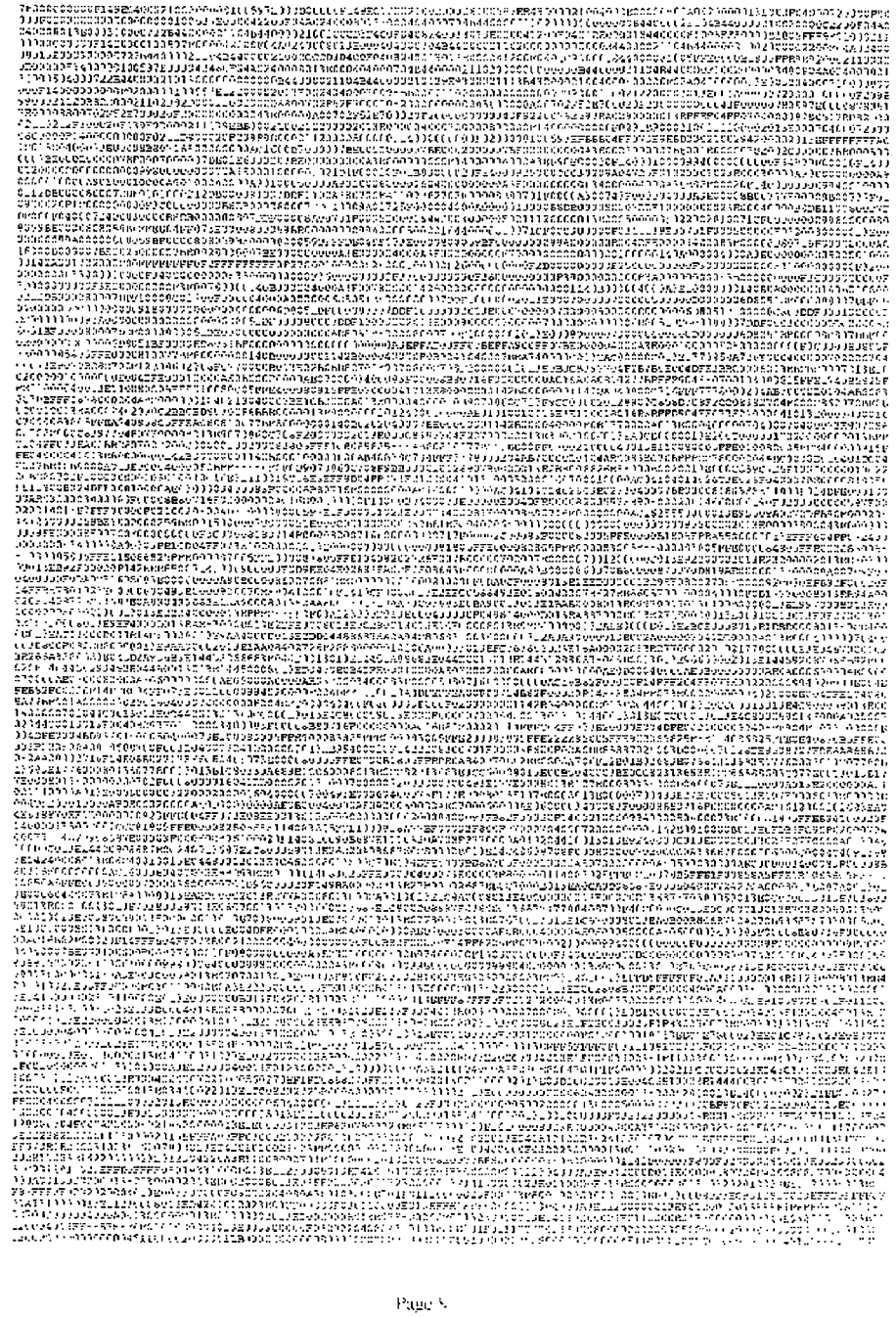

PLAYER.BIN - Copyright SONY Corp. 19..
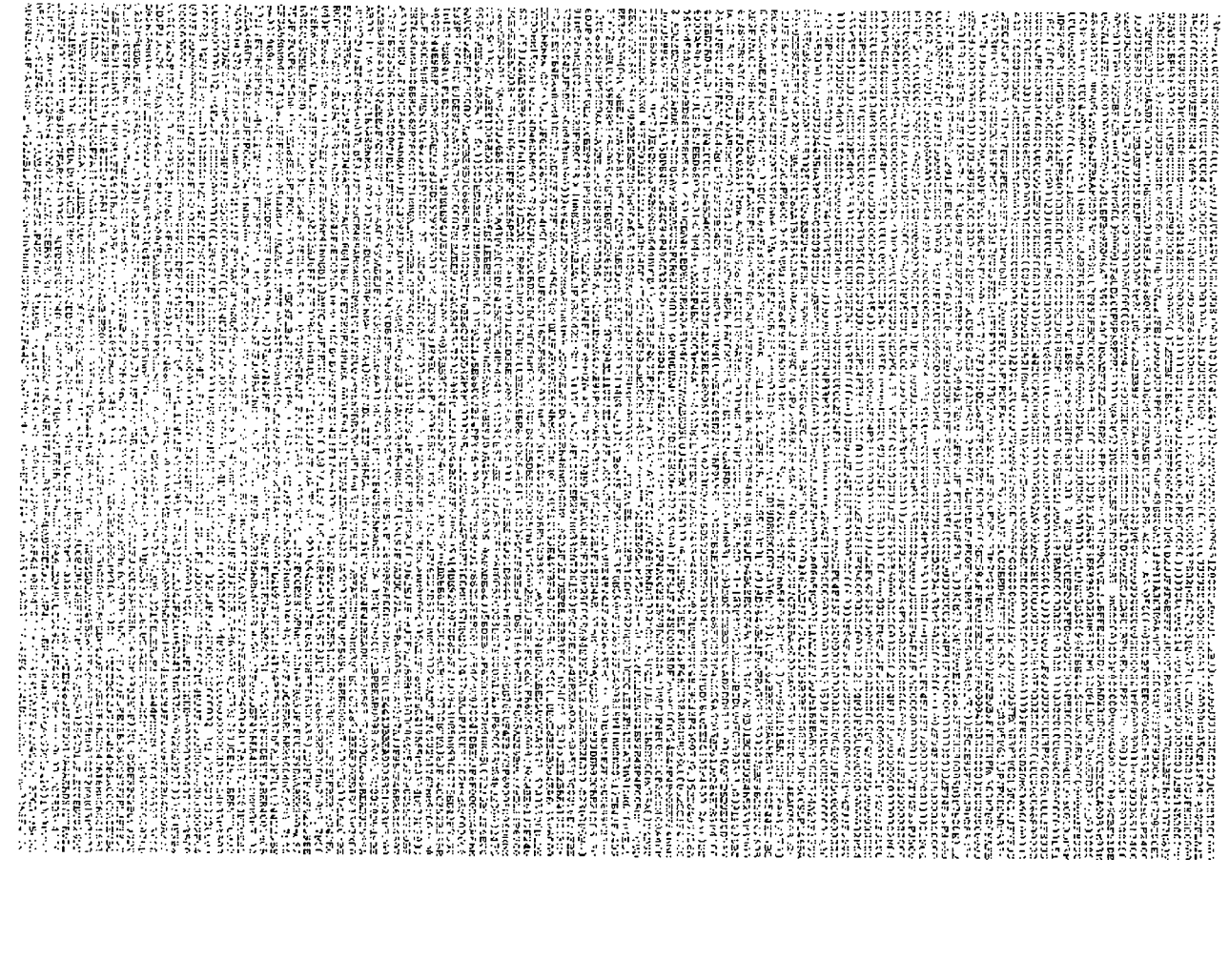

PLAYER.BIN - Copyright SONY Corp. 1995

PLAYER.BIN - Copyright SONY Corp. 1992
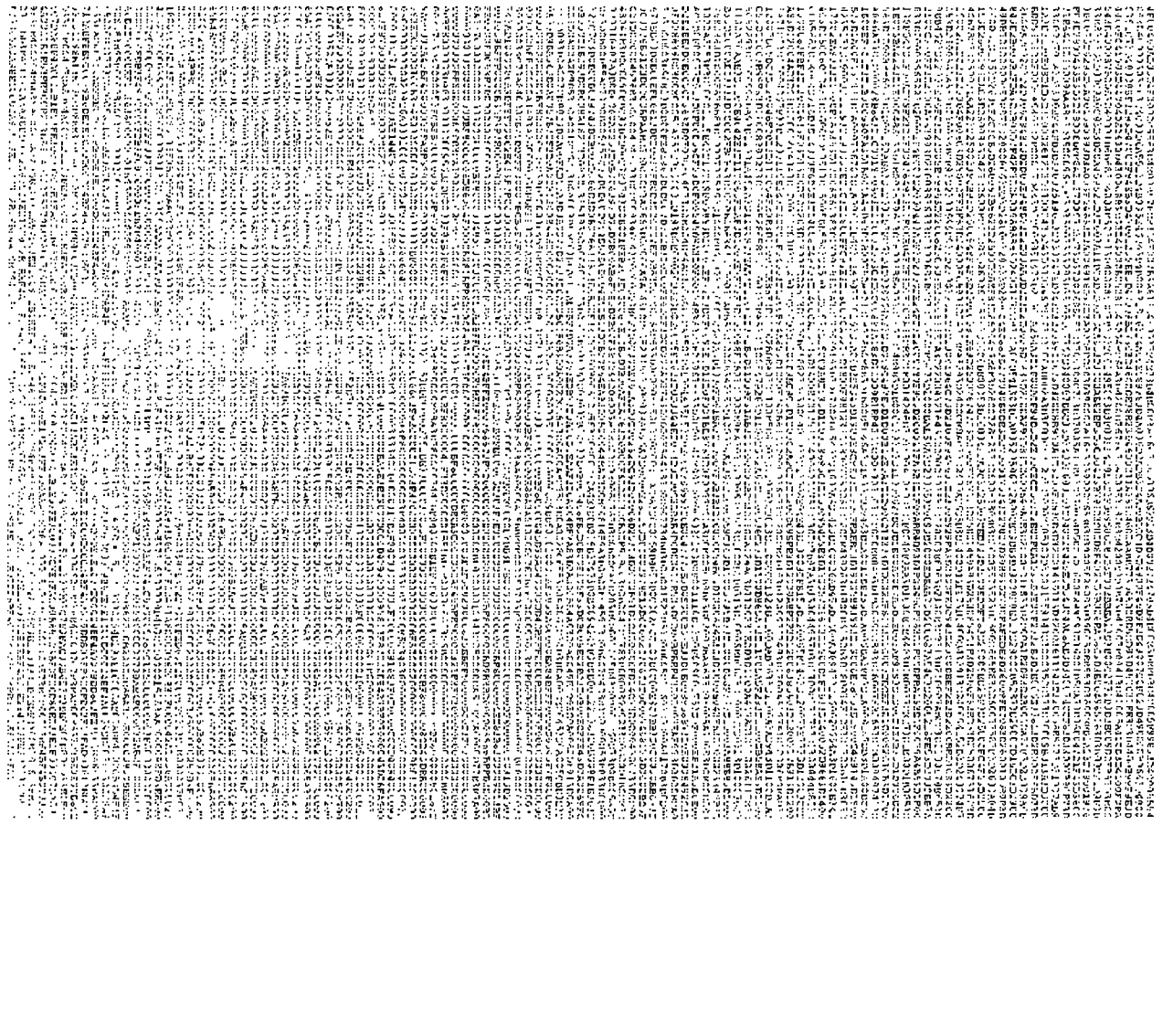

PLAYER.BIN - Copyright SONY Corp. 1...

PLAYER.BIN : Copyright SONY Corp. 199_

PLAYER BIN - Copyright SONY Corp 199-

PLAYER BIN - Copyright SONY Corp. 1 . . .

PLAYER BIN - Copyright SONY Corp. 199..
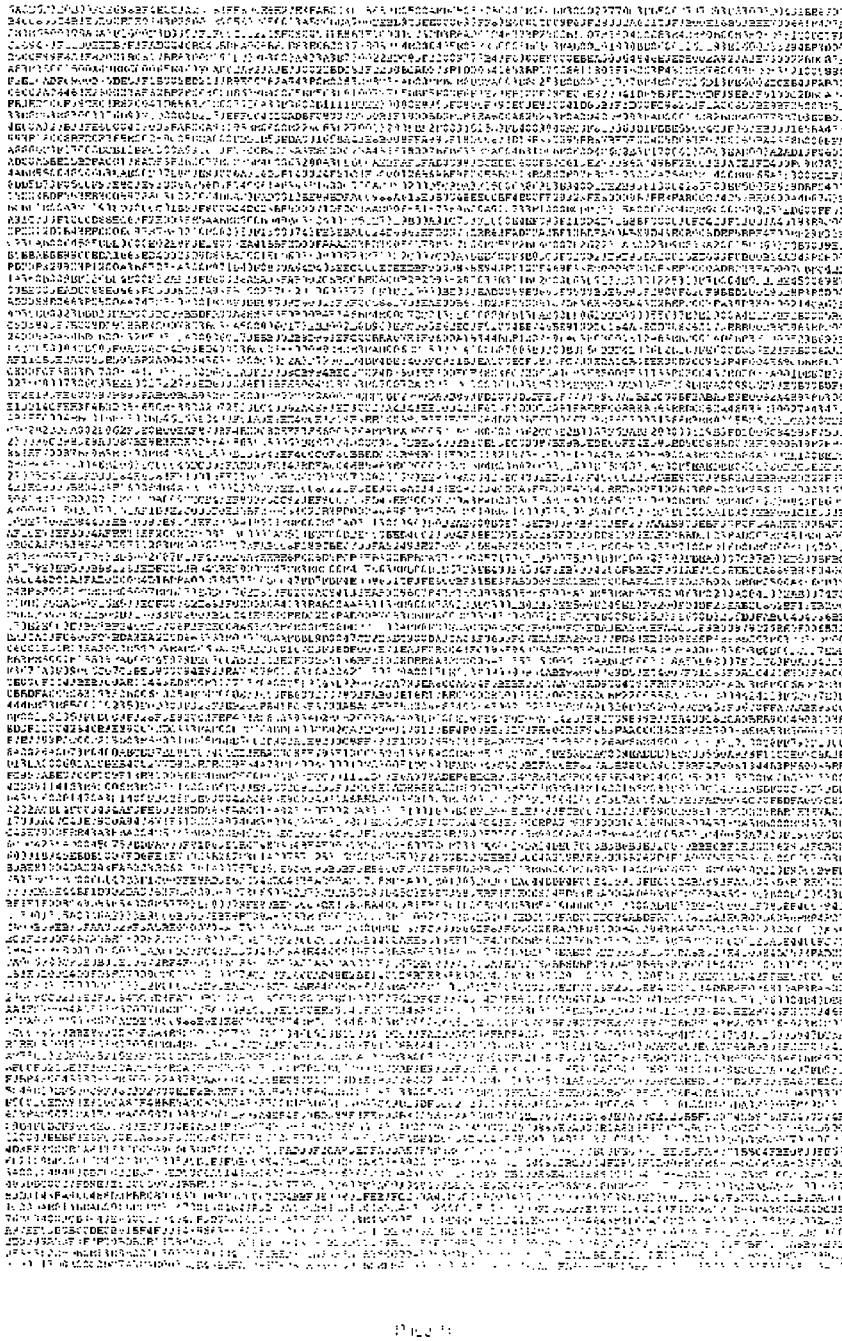

PLAYER.BIN - Copyright SONY Corp. 1992

PLAYER.BIN · Copyright SONY Corp. 199_
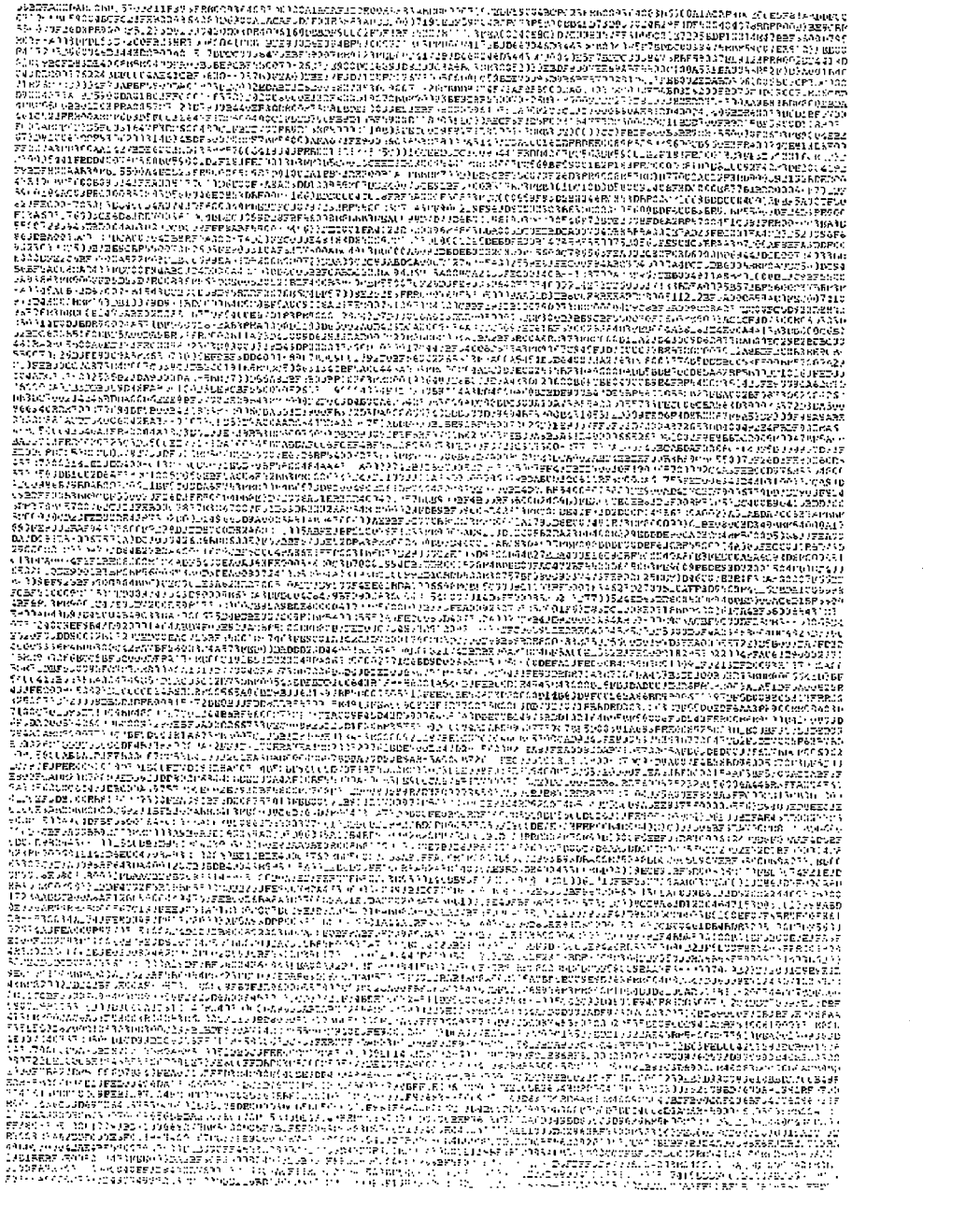

PLAYER.BIN - Copyright SONY Corp. 19..

PLAYER.BIN Copyright SONY Corp. 199[illegible]
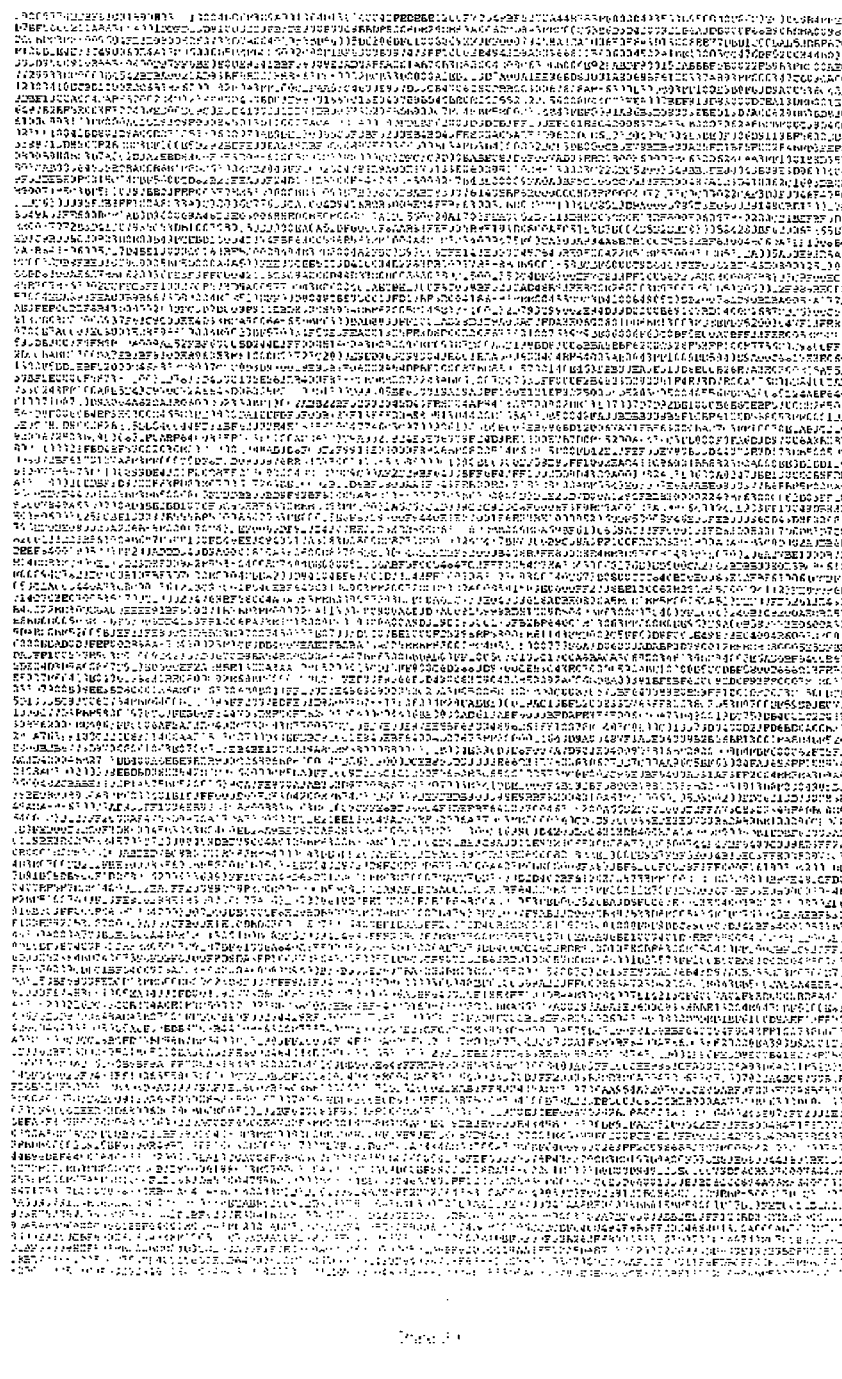

PLAYER.BIN Copyright SONY Corp. 1994

PLAYER.BIN - Copyright SONY Corp. 19..

I claim:

1. A method for performing digital surround sound decoding in a system including a processor coupled to a memory, wherein the memory includes a plurality of lookup tables having parameter values, wherein the system is provided with digitized left and right audio signal data, wherein the audio signal data includes encoded center and surround signal data, the method comprising the steps of deriving left, right, center and surround values from the digitized left and right audio signal data;

forming indexes from the left, right, center and surround values for indexing the lookup tables;

retrieving parameter values from the lookup tables according to the derived indexes; and combining the retrieved parameter values with the left, right, center and surround values to generate decoded left, right center and surround channel signals.

2. A digital surround sound decoder comprising:

a processor coupled to a memory;

first processing means for deriving left, right, center and surround values from digitized left and right audio signal data;

a plurality of lookup tables stored in the memory, wherein each lookup table includes parameter values;

second processing means for indexing the lookup tables with indexes derived from the left, right, center and surround values, and for retrieving the parameter values from the lookup tables according to the derived indexes; and third processing means for combining the retrieved parameter values with the left, right, center and surround values to generate decoded left, right, center and surround channel signals.

* * * * *